US008146182B2

(12) United States Patent
Bauer

(10) Patent No.: US 8,146,182 B2
(45) Date of Patent: Apr. 3, 2012

(54) APPARATUS FOR MOUNTING CURVED ROD

(75) Inventor: Alan M. Bauer, Medina, OH (US)

(73) Assignee: Moen Incorporated, North Olmsted, OH (US)

( * ) Notice: Subject to any disclaimer, the term of this patent is extended or adjusted under 35 U.S.C. 154(b) by 1289 days.

(21) Appl. No.: 11/803,533

(22) Filed: May 15, 2007

(65) Prior Publication Data

US 2008/0282464 A1 Nov. 20, 2008

(51) Int. Cl.
*A47K 3/08* (2006.01)

(52) U.S. Cl. ..... 4/558

(58) Field of Classification Search ..... 4/558, 610, 4/557, 607–608
See application file for complete search history.

(56) References Cited

U.S. PATENT DOCUMENTS

| | | | | |
|---|---|---|---|---|
| 2,195,979 | A | | 4/1940 | Ziolowski |
| 2,498,590 | A | | 2/1950 | Straus |
| 3,204,898 | A | * | 9/1965 | Manning |
| 3,580,397 | A | | 5/1971 | Triplett |
| 5,022,104 | A | * | 6/1991 | Miller |
| 5,076,523 | A | | 12/1991 | Wang |
| 5,330,061 | A | * | 7/1994 | Geltz |
| 5,538,364 | A | | 7/1996 | Huntsman |
| 5,615,721 | A | * | 4/1997 | Winter ..... 160/38 |
| 5,799,804 | A | | 9/1998 | Sharpe |
| 5,894,610 | A | * | 4/1999 | Winter |
| 6,199,808 | B1 | * | 3/2001 | Lin |
| 6,216,287 | B1 | * | 4/2001 | Wise |
| 6,263,523 | B1 | * | 7/2001 | Moore |
| 6,694,543 | B2 | * | 2/2004 | Moore |
| 7,076,815 | B2 | * | 7/2006 | Orpilla |
| 7,512,999 | B2 | * | 4/2009 | Caon |
| 2003/0217410 | A1 | | 11/2003 | Moore |
| 2005/0211860 | A1 | * | 9/2005 | Broyles |
| 2005/0268394 | A1 | | 12/2005 | Monk et al. |
| 2006/0175496 | A1 | * | 8/2006 | Lai |
| 2008/0028513 | A1 | * | 2/2008 | Didehvar |

* cited by examiner

*Primary Examiner* — Lori Baker
(74) *Attorney, Agent, or Firm* — Calfee, Halter & Griswold LLP

(57) ABSTRACT

A mounting assembly is used to mount a curved rod to a mounting surface. The mounting assembly includes a base, a guide and a cover. The base is fixed to the mounting surface by inserting screws through holes in the base and into the mounting surface. The guide fits around the base and can move along a length of the base. The cover is placed over the base and secured to the guide, such that the cover can also move along the length of the base. The mounting assembly interfaces with an end of the curved rod that approaches the mounting assembly at a given angle. Movement of the cover allows the mounting assembly to interface with ends of curved rods approaching the mounting assembly over a range of angles. The mounting assembly can include a shaft that is connected to the base and interfaces with the end of the curved rod.

19 Claims, 29 Drawing Sheets

SECTION A-A

SECTION A-A

SECTION A-A

SECTION A-A

SECTION A-A

SECTION A-A

SECTION B-B

APPARATUS FOR MOUNTING CURVED ROD

The invention relates generally to mounting methods and systems and, more particularly, to an apparatus for mounting a curved rod.

BACKGROUND

It is known to use a shower curtain to prevent water from escaping a bath and/or shower unit (e.g., a bath tub, a shower stall or a combination thereof), hereinafter "bath/shower unit," while a user is showering. To support the shower curtain, a shower rod is typically mounted across an opening to the bath/shower unit. The shower rod is mounted horizontally across the opening and the shower curtain is hung from the shower rod, for example, using rings or hooks. As necessary the shower curtain can be opened or closed by sliding the rings or hooks along the shower rod. When the shower curtain is closed, the shower curtain acts as a barrier to keep water that would otherwise travel outside the bath/shower unit in the bath/shower unit where it can flow out a drain.

Shower rods traditionally have been straight. However, the use of curved shower rods has become more common. Curved shower rods allow the shower curtain to curve away from the bath/shower unit and, thus, provide a greater volume in the bath/shower unit. In particular, the amount of space (e.g., shoulder and elbow room) available to the user in the center of the bath/shower unit can be increased.

Bath/shower units come in a variety of sizes and shapes. The bath/shower unit itself or opposing walls near the bath/shower unit form a pair of mounting surfaces between which the curved shower rod is installed. Because of the variation in the sizes and/or shapes of the bath/shower units and/or the spacing between the nearby walls, the longitudinal distance that the curved shower rod must span varies, often varying over an inch or more.

Thus, installation of the curved shower rod often requires careful selection of a curved shower rod having an appropriate length or modification to an overall length of the curved shower rod for it to properly fit between the mounting surfaces. As the length of the curved shower rod changes or is otherwise modified to fit between the mounting surfaces, an angle that the curved shower rod forms with the mounting surface changes (see FIGS. 1A and 1B).

As shown in FIG. 1A, a curved shower rod 100 has a length $L_1$ and fits between a pair of mounting surfaces 102. The distance $D_1$ between the mounting surfaces 102 is larger than the distance $L_1$. A bath/shower unit 104 is disposed between the mounting surfaces 102. Mounting assemblies 106 can be used to secure each end 108 of the curved shower rod 100 to the mounting surfaces 102. The ends 108 of the curved shower rod 100 approach the mounting assemblies 106 (fixed to the mounting surfaces 102) at an angle $\theta_1$. The mounting assemblies 106 have structure for interfacing with the curved shower rod 100 at the angle $\theta_1$.

The curved shower rod 100 with the length $L_1$ will not, however, fit between a pair of mounting surfaces 110 (see FIG. 1B). In particular, a distance $D_2$ between the mounting surfaces 110 is less than the length $L_1$. Accordingly, another curved shower rod 112 having a length $L_2$ that will fit between the mounting surfaces 110 must be used.

As shown in FIG. 1B, the curved shower rod 112 having the length $L_2$ fits between the mounting surfaces 110. A bath/shower unit 114 is disposed between the mounting surfaces 110. Mounting assemblies 116 can be used to secure each end 118 of the curved shower rod 112 to the mounting surfaces 110. The ends 118 of the curved shower rod 112 approach the mounting assemblies 116 (fixed to the mounting surfaces 110) at an angle $\theta_2$. The mounting assemblies 116 have structure for interfacing with the curved shower rod 112 at the angle $\theta_2$.

Because the length $L_2$ of the curved shower rod 112 differs from the length $L_1$ of the curved shower rod 100, the approaching angle $\theta_2$ of the curved shower rod 112 differs from the approaching angle $\theta_1$ of the curved shower rod 100. As a result, different mounting assemblies 106 and 116 are used to install the curved shower rods 100 and 112 to account for the respective different approaching angles $\theta_1$ and $\theta_2$. This is disadvantageous, for example, because it requires the manufacture and maintenance of multiple different mounting assemblies.

To overcome these disadvantages, the same mounting assembly (106 or 116) can be made to accommodate both the curved shower rod 100 and the curved shower rod 112. In particular, the mounting assembly 106, 116 is provided with structure that can pivot or swivel to interface with a curved shower rod across a range of approaching angles (including $\theta_1$ and $\theta_2$). This approach, however, has drawbacks as well. For example, a decorative cover that is commonly installed over the mounting assembly 106, 116 must have an opening large enough to allow the pivoting/swiveling structure of the mounting assembly 106, 116 to move through a wide range of motion for accommodating the range of approaching angles. Such a large opening reduces the aesthetic value of the cover. Generally, the curved shower rod 100, 112 will only occupy a portion of the opening, while the remaining portion of the opening will allow the user to see the internal structure of the mounting assembly 106,116 (i.e., below the cover), thereby detracting from the aesthetic appearance of the installed curved shower rod 100, 112.

Consequently, there is a need in the art for an apparatus for mounting curved shower rods of varying lengths, the apparatus including a decorative cover that conceals a pivoting/swiveling mechanism and/or other internal components of the apparatus.

SUMMARY

In view of the above, it is an exemplary aspect to provide an apparatus for mounting curved rods (e.g., curved shower rods) of varying lengths.

It is another exemplary aspect to provide an apparatus for mounting a curved rod. The apparatus includes a base that can be secured to a surface. The apparatus also includes a cover that substantially covers the base to conceal the base from view. The cover includes an opening through which the curved rod can extend. The cover can move relative to the base between a first position and a second position. When the cover is in the first position, the opening defines a first mounting angle for mounting the curved rod. When the cover is in the second position, the opening defines a second mounting angle for mounting the curved rod. An end of the curved rod interfaces with the base. Alternatively, the end of the curved rod interfaces with a shaft that is pivotably connected to the base.

It is still another exemplary aspect to provide a curved rod assembly. The assembly includes a curved rod and a pair of mounting assemblies for mounting the curved rod. Each mounting assembly includes a base that can be secured to a surface and a cover that substantially covers the base. For each mounting assembly, the cover includes an opening through which the curved rod can extend. The cover can move relative to the base between a first position and a second position. When the cover is in the first position, the opening defines a first mounting angle for mounting the curved rod. When the cover is in the second position, the opening defines a second mounting angle for mounting the curved rod. An end of the curved rod interfaces with the base. Alternatively, the end of the curved rod interfaces with a shaft that is pivotably connected to the base.

It is yet another exemplary aspect to provide an apparatus for mounting a curved rod. The apparatus includes a base that can be secured to a surface. The base is operable to interface with an end of the curved rod. The apparatus also includes a guide. The guide surrounds the base and is operable to move relative to the base. Movement of the guide changes a mounting angle between the base and the end of the curved rod.

BRIEF DESCRIPTION OF THE DRAWINGS

The above aspects and additional aspects, features and advantages will become readily apparent by describing in detail exemplary embodiments thereof with reference to the attached drawings, wherein like reference numerals denote like elements, and:

FIG. 3A is a perspective view of the mounting assembly. FIG. 3B is a cross-sectional view of the mounting assembly shown in FIG. 3A, along line A-A.

FIG. 4A is a perspective view of the base. FIG. 4B is a side elevational view of the base. FIG. 4C is a top plan view of the base. FIG. 4D is a cross-sectional view of the base shown in FIG. 4C, along line A-A. FIG. 4E is a bottom plan view of the base.

FIG. 5A is a perspective view of the shaft. FIG. 5B is a side elevational view of the shaft. FIG. 5C is a bottom plan view of the shaft. FIG. 5D is a cross-sectional view of the shaft shown in FIG. 5C, along line A-A.

FIG. 7A is a top perspective view of the guide. FIG. 7B is a bottom perspective view of the guide. FIG. 7C is a top plan view of the guide. FIG. 7D is a bottom plan view of the guide. FIG. 7E is a cross-sectional view of the guide shown in FIG. 7D, along line A-A.

FIG. 8A is a perspective view of the cover. FIG. 8B is a top plan view of the cover. FIG. 8C is a cross-sectional view of the cover shown in FIG. 8B, along line A-A. FIG. 8D is a cross-sectional view of the cover shown in FIG. 8C, along line B-B.

DETAILED DESCRIPTION

Figure 1A:
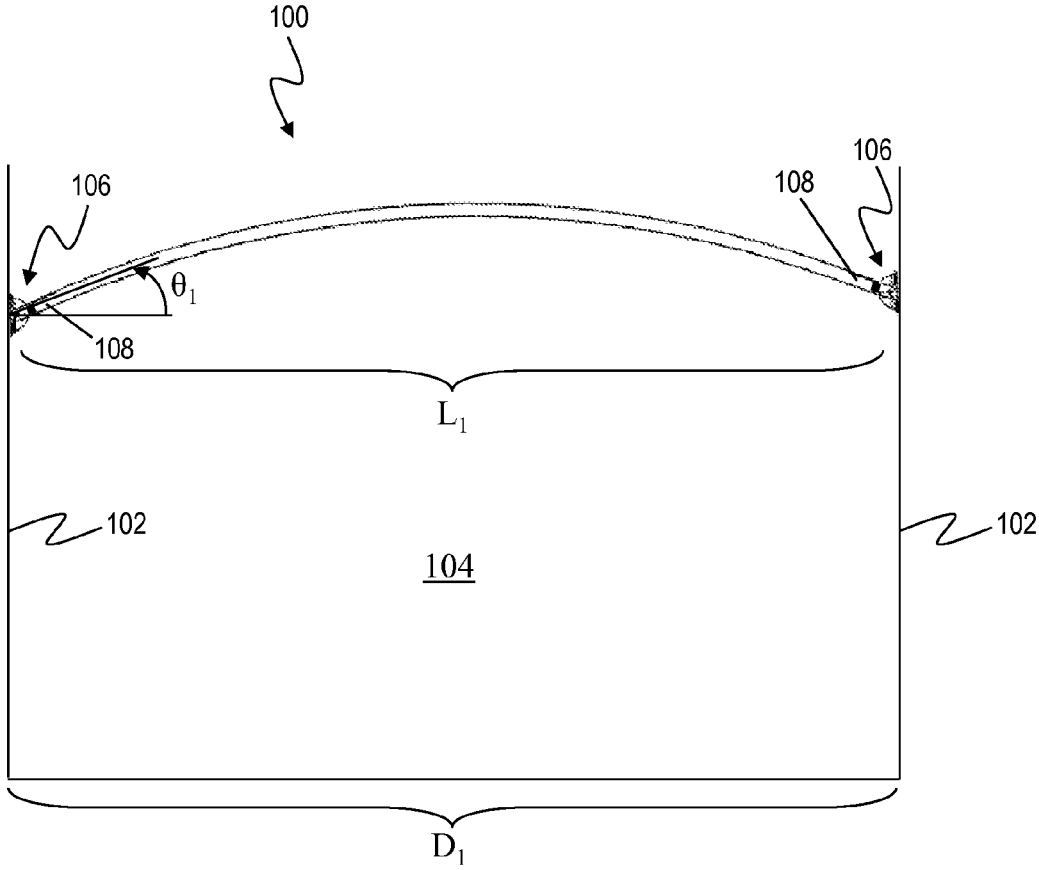
FIG. 1A PRIOR ART
FIGS. 1A-1B are diagrams illustrating curved shower rods of different lengths being installed between mounting surfaces separated by different distances.
Figure 1B:
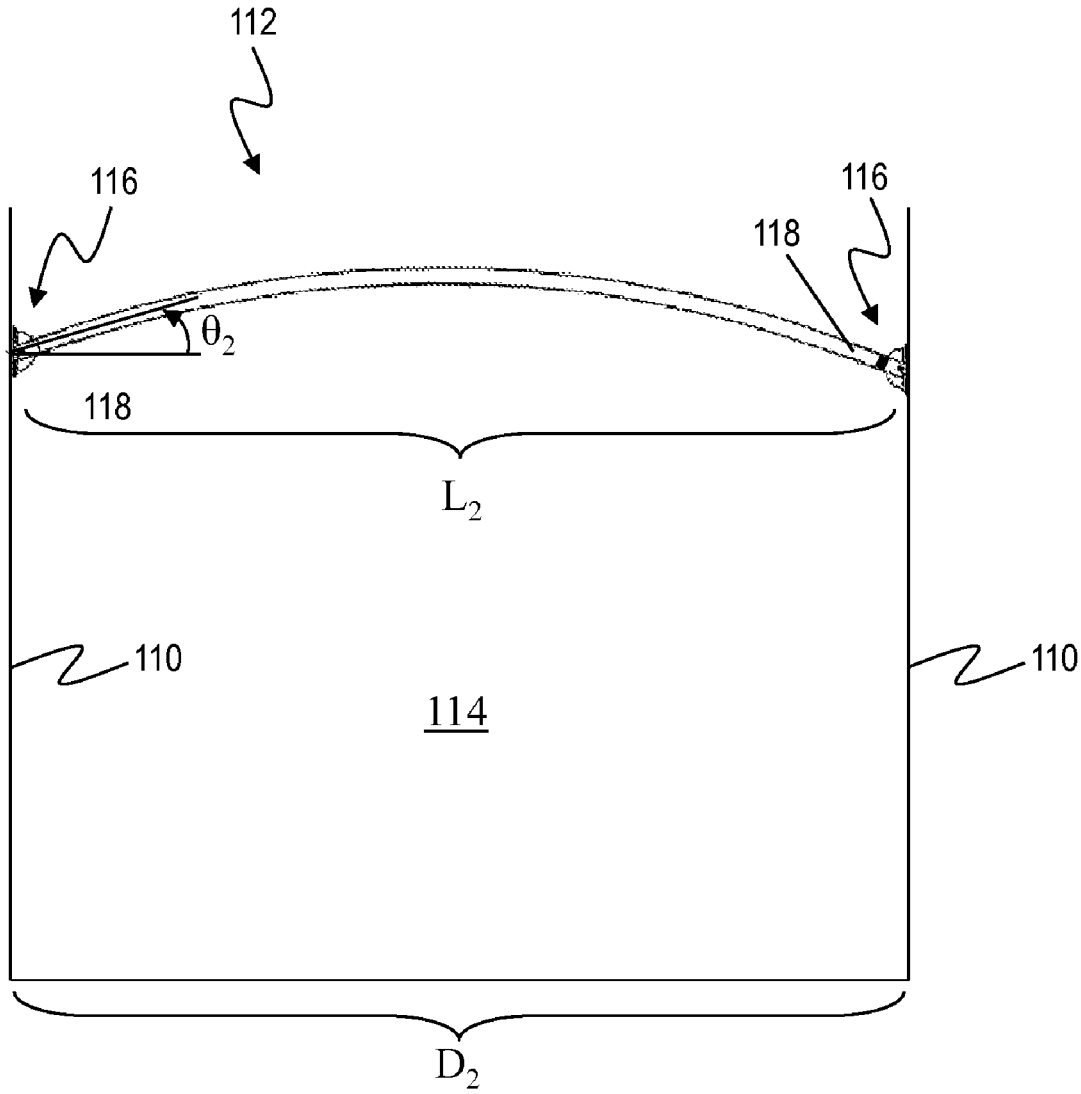
FIG. 1B PRIOR ART

While the general inventive concept is susceptible of embodiment in many different forms, there are shown in the drawings and will be described herein in detail specific embodiments thereof with the understanding that the present disclosure is to be considered as an exemplification of the principles of the general inventive concept. Accordingly, the general inventive concept is not intended to be limited to the specific embodiments illustrated herein.

Figure 2A:
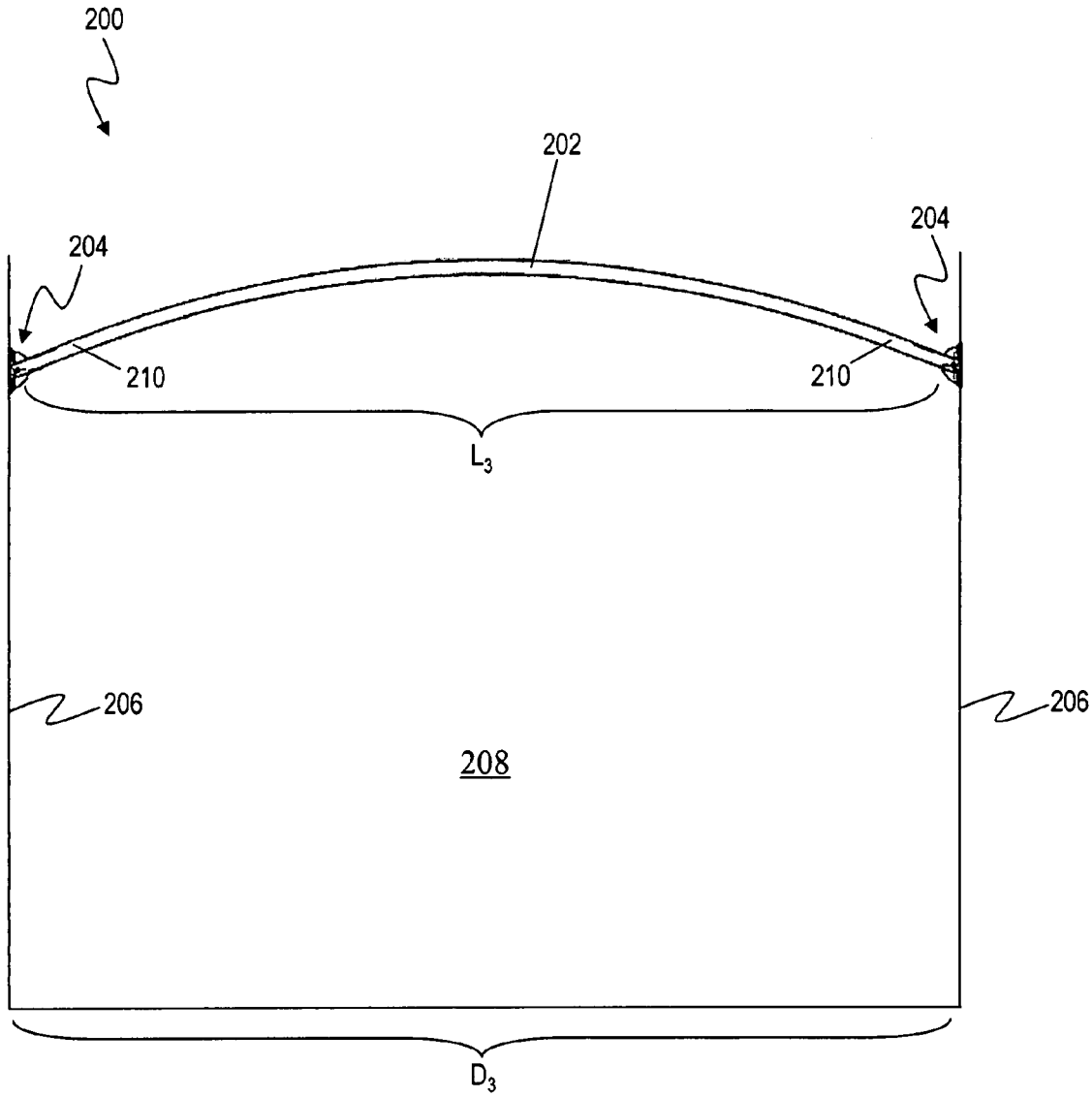
FIG. 2A is a diagram illustrating a curved shower rod having a fixed length installed between mounting surfaces separated by a predetermined distance, according to an exemplary embodiment.
Figure 2B:
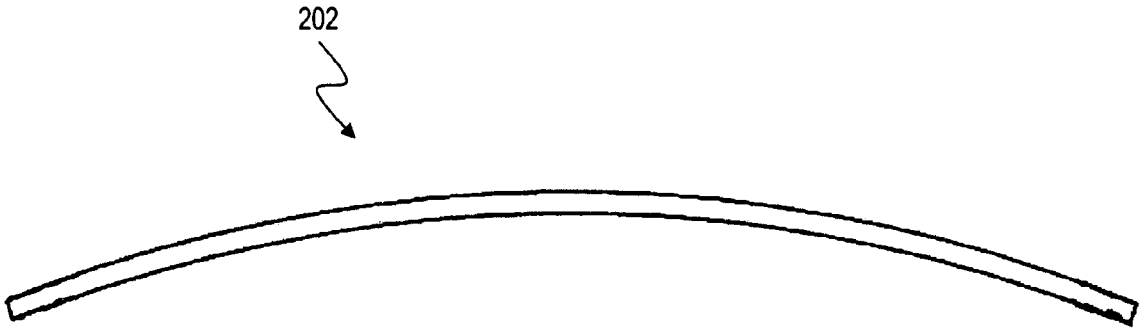
FIG. 2B shows the curved shower rod of FIG. 2A.

A curved shower rod assembly 200, according to one exemplary embodiment, is shown in FIG. 2A. The curved shower rod assembly 200 includes a curved shower rod 202 (see FIG. 2B) and a pair of mounting assemblies 204. Each mounting assembly 204 is installed on a corresponding mounting surface 206 on or near a bath/shower unit 208.

Each mounting assembly 204 is operable to interface with an end 210 of the curved shower rod 202 to mount the curved shower rod 202 between the mounting surfaces 206. In this manner, a shower curtain (not shown) hanging from the curved shower rod 202 can form a barrier for retaining water, discharged during a shower, in the bath/shower unit 208.

As further described below, the mounting assemblies 204 are operable to mount the curved shower rod 202 having a length within a range of lengths $L_X$ (e.g., including $L_1$ and $L_2$) between the mounting surfaces 206. As a result, the mounting assemblies 204 allow the curved shower rod 202 to be installed between the mounting surfaces 206 separated by a range of distances $D_X$ (e.g., including $D_1$ and $D_2$). For example, if the mounting surfaces 206 are separated by a distance $D_3$, the curved shower rod 202 can be modified (e.g., cut) to reduce its length to a length $L_3$ that fits between the mounting surfaces 206.

Figure 3A:
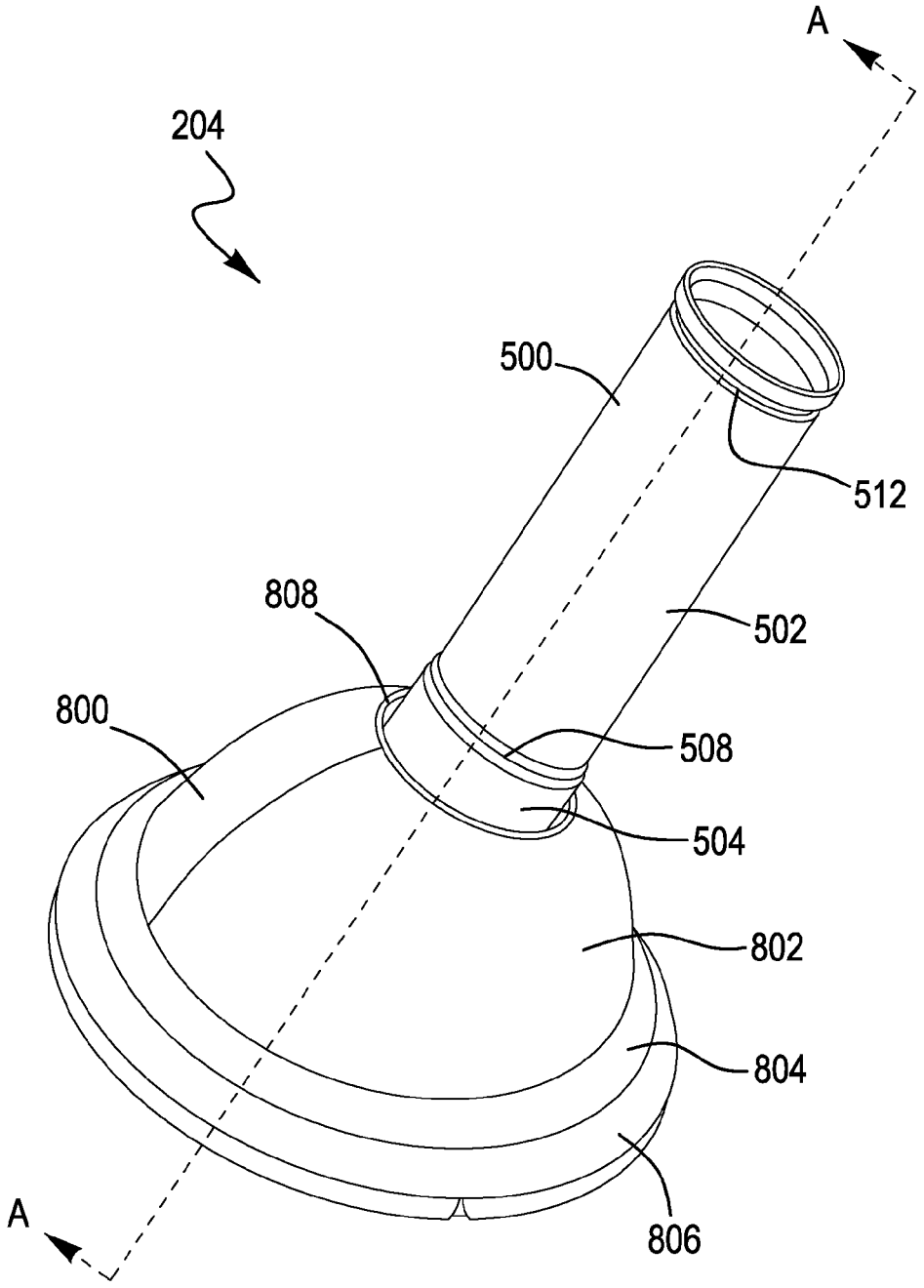
FIGS. 3A-3B show an exemplary mounting assembly for affixing a curved shower rod to a mounting surface, according to an exemplary embodiment.
Figure 3B:
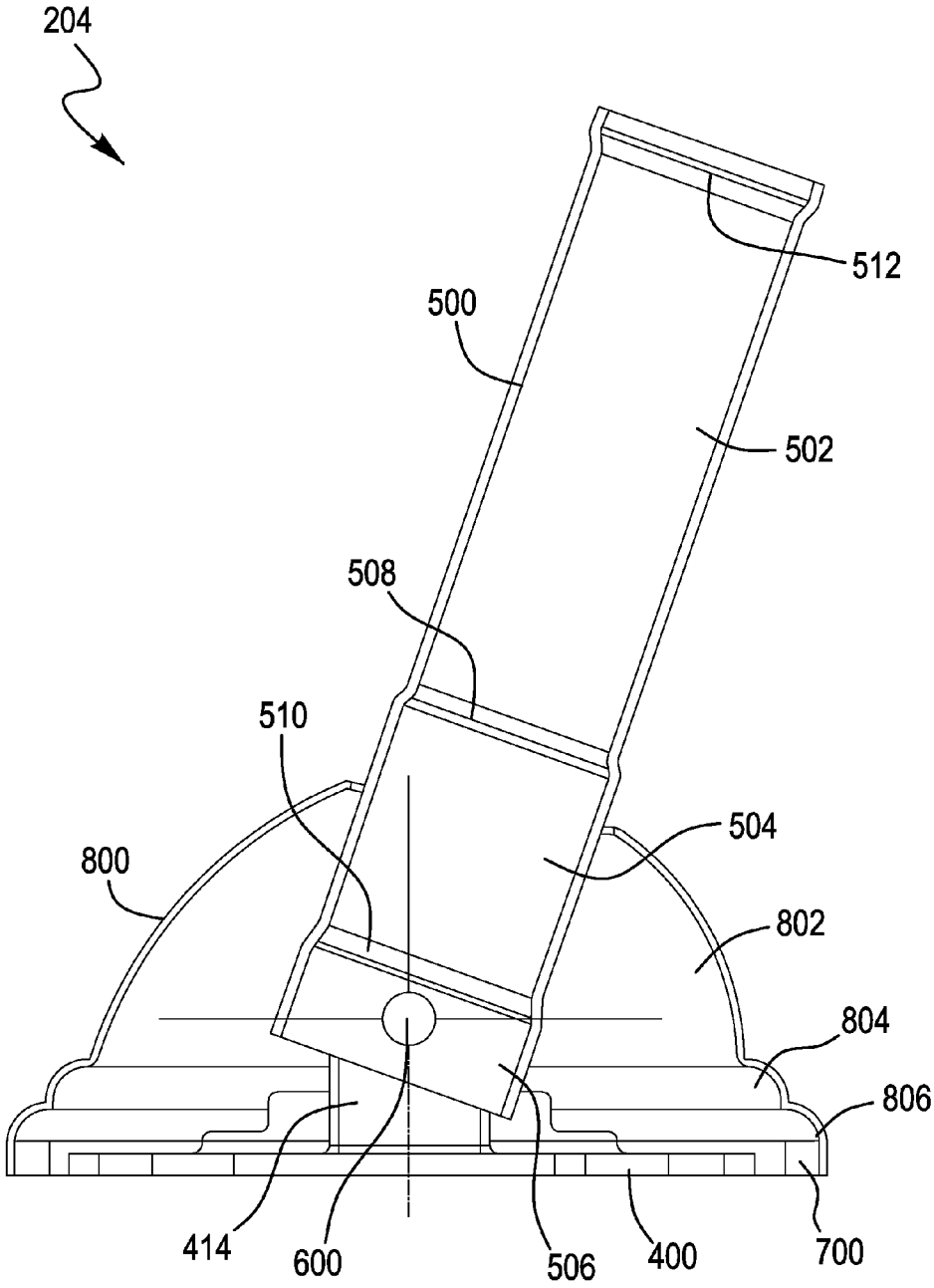
Figure 4A:
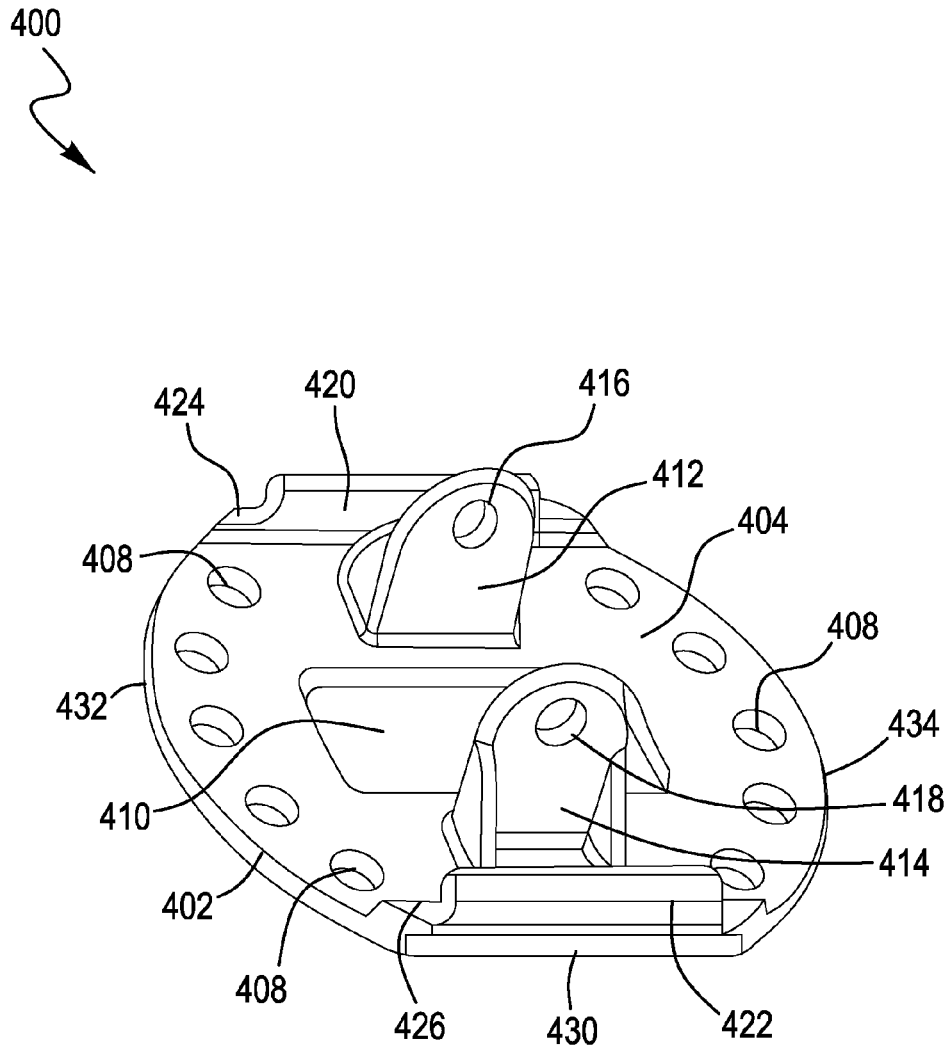
FIGS. 4A-4E show an exemplary base, according to an exemplary embodiment, for use in the mounting assembly of FIGS. 3A-3B.
Figure 4B:
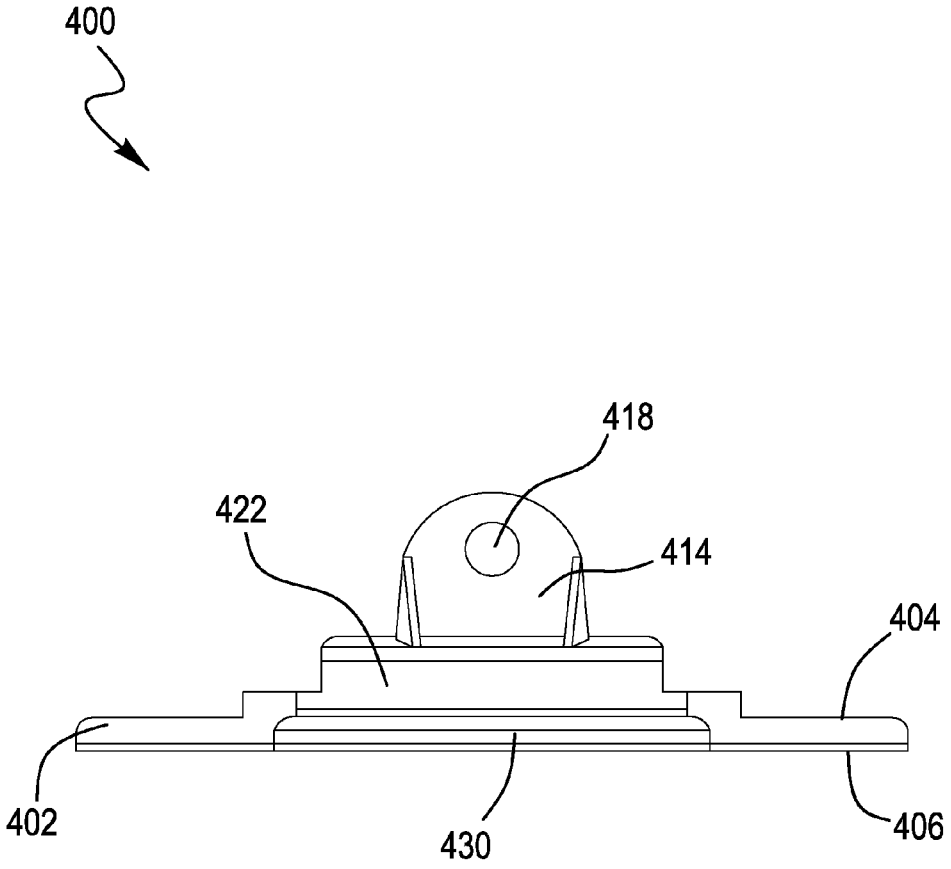
Figure 4C:
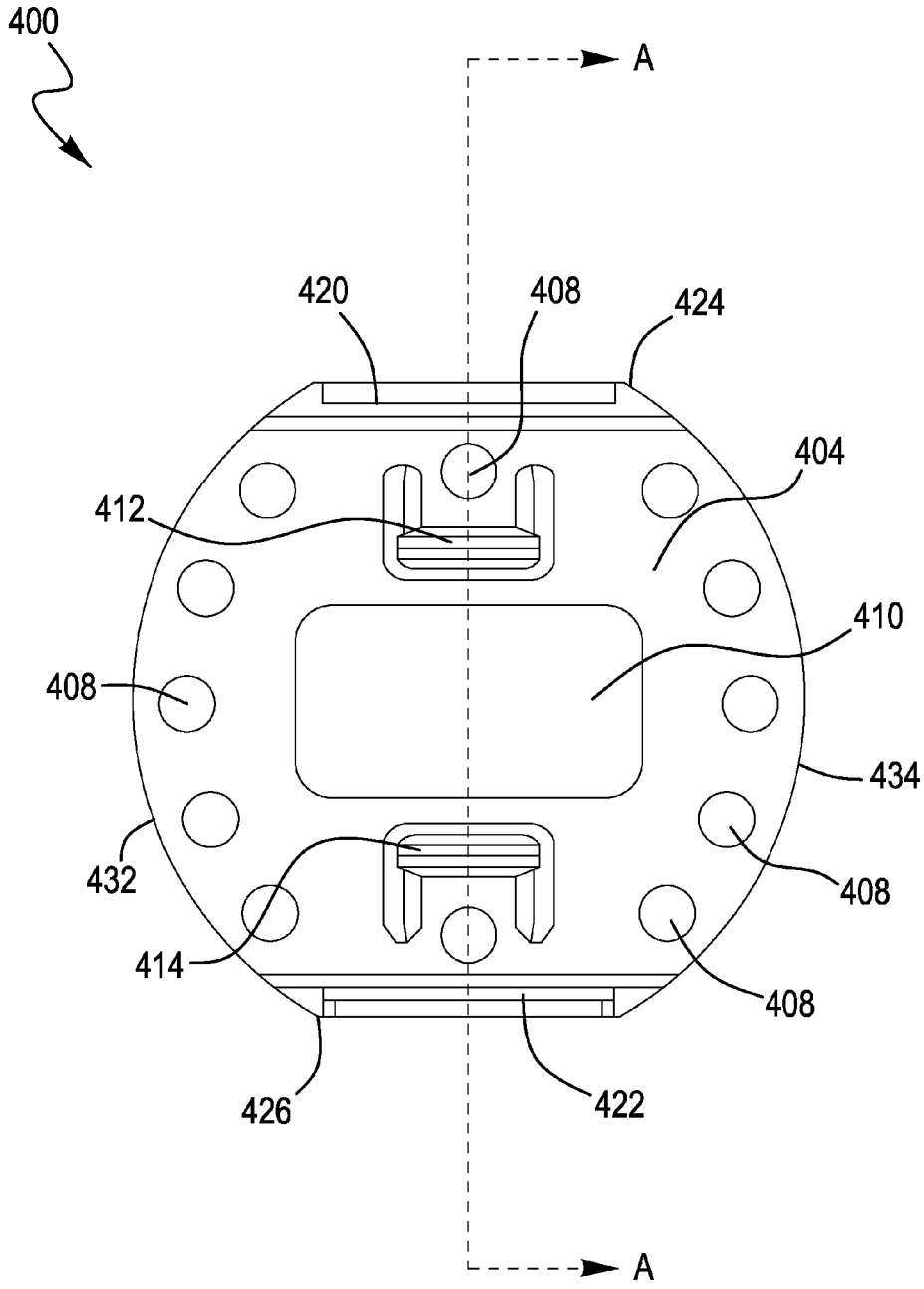
Figure 4D:
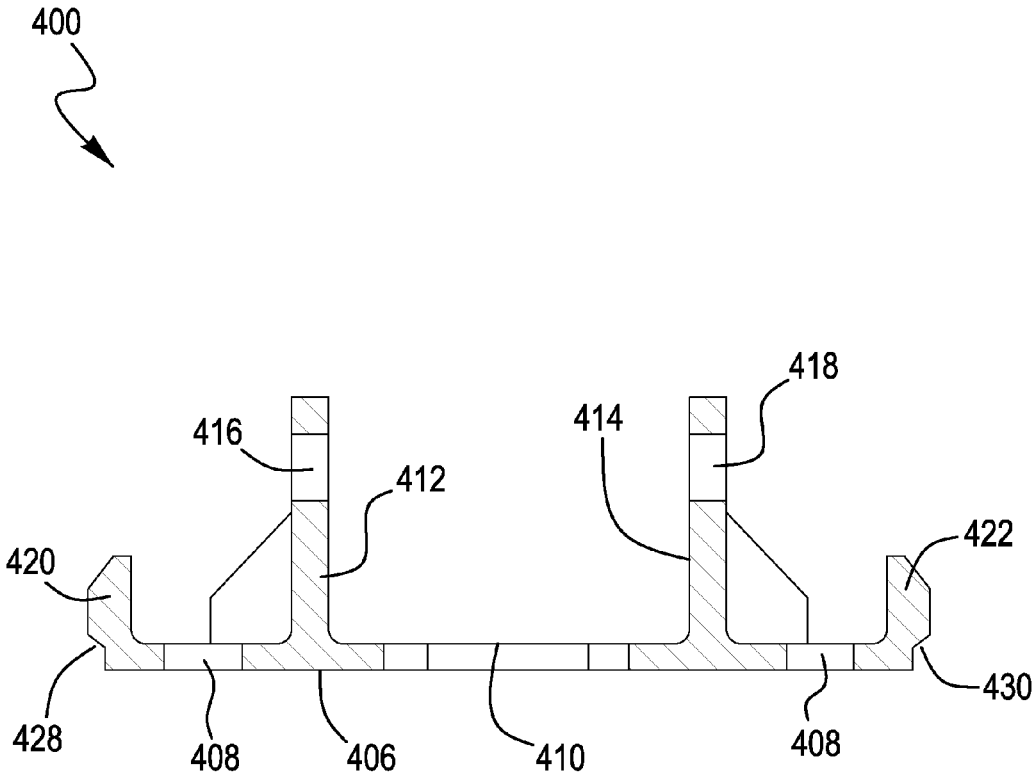
Figure 4E:
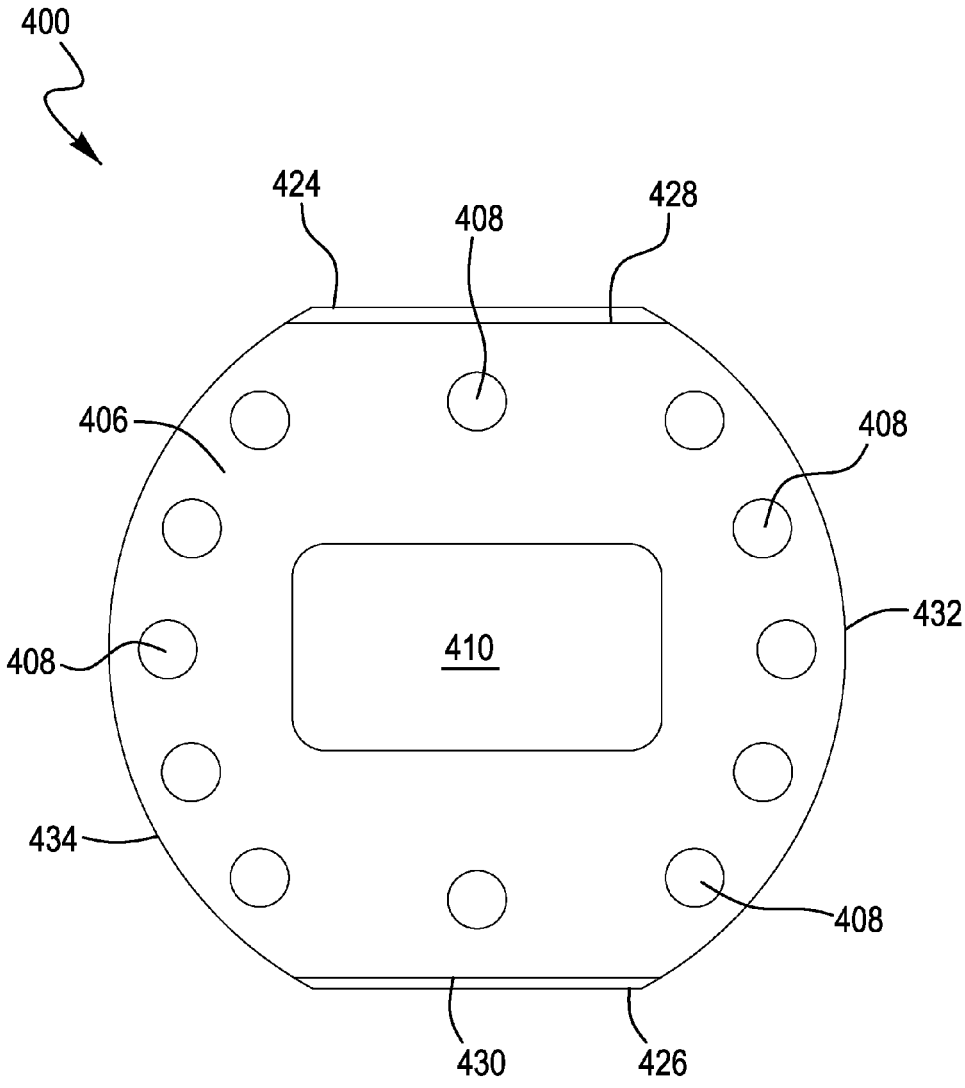
Figure 5A:
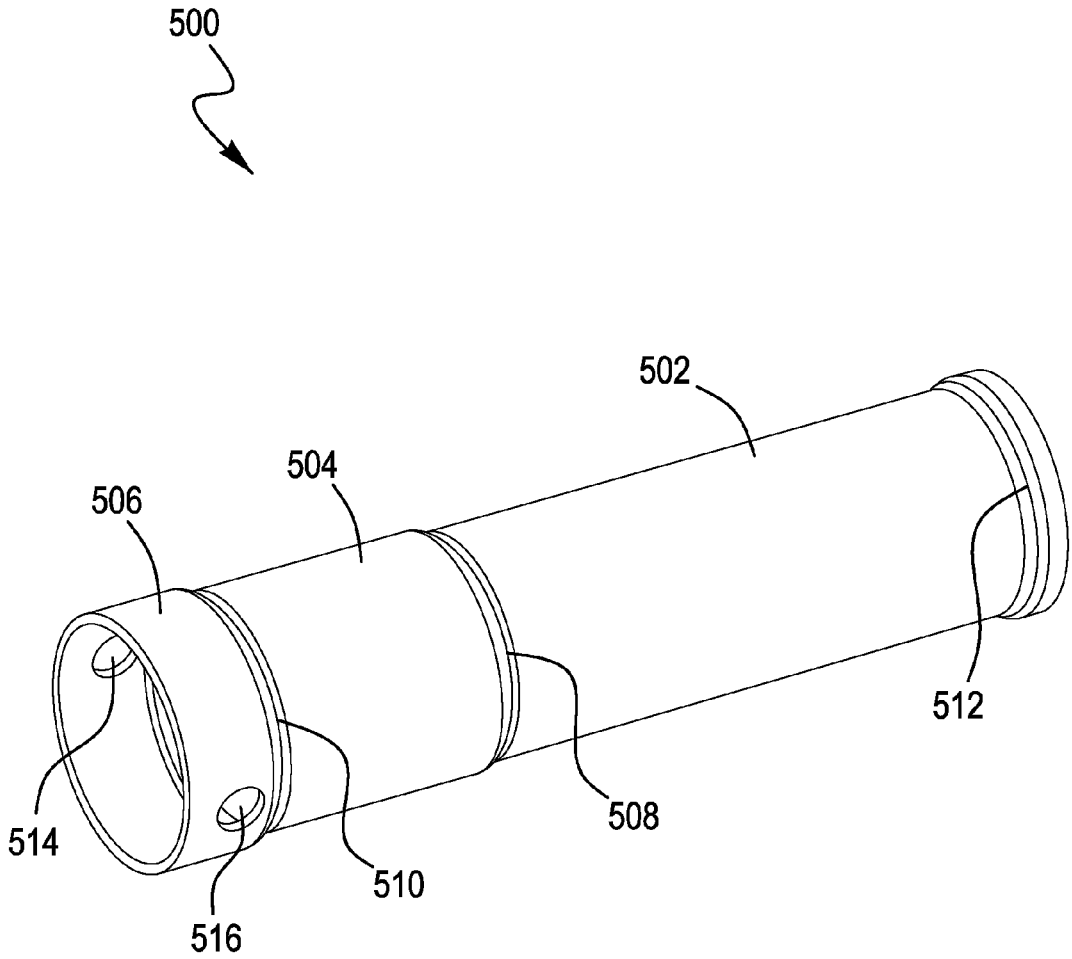
FIGS. 5A-5D show an exemplary shaft, according to an exemplary embodiment, for use in the mounting assembly of FIGS. 3A-3B.
Figure 5B:
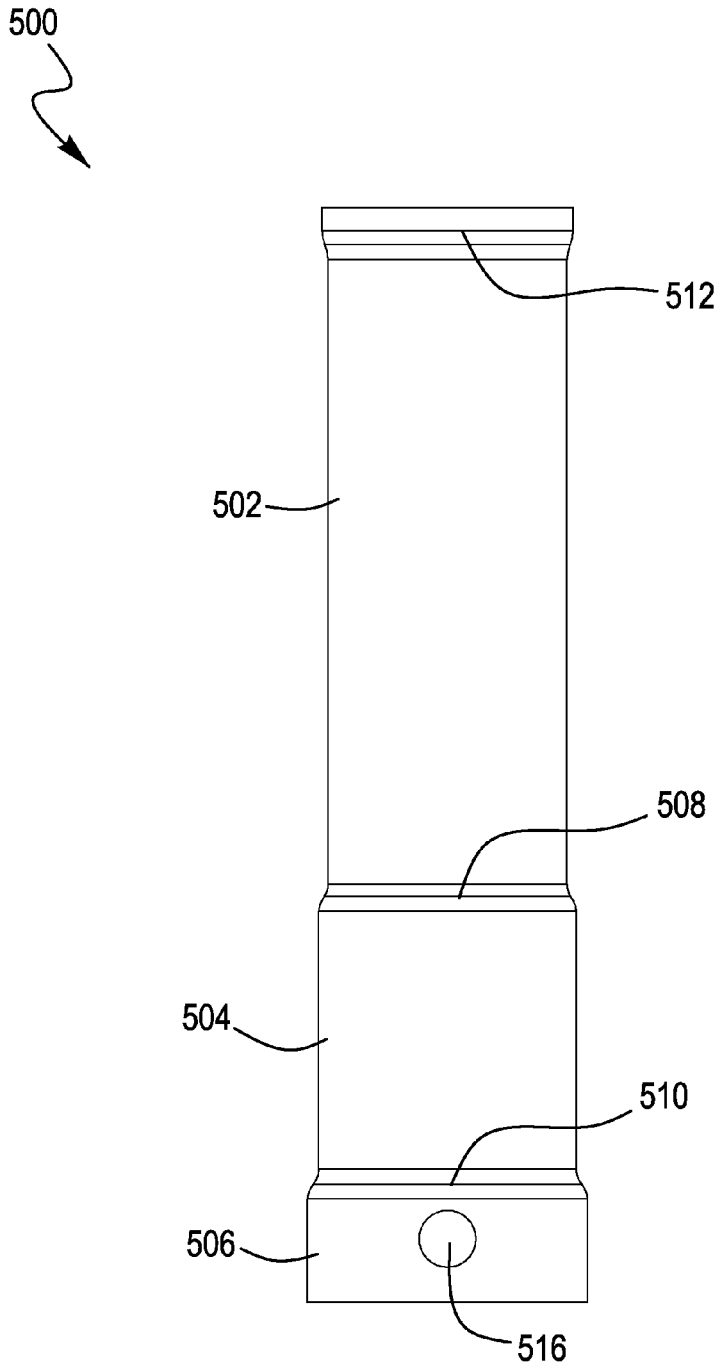
Figure 5C:
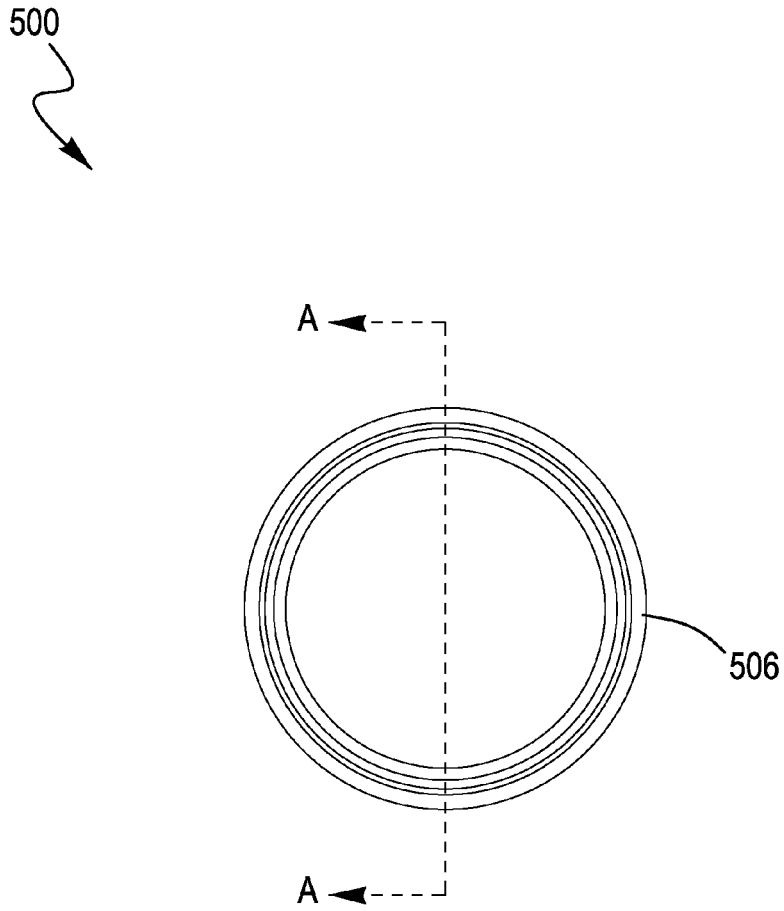
Figure 5D:
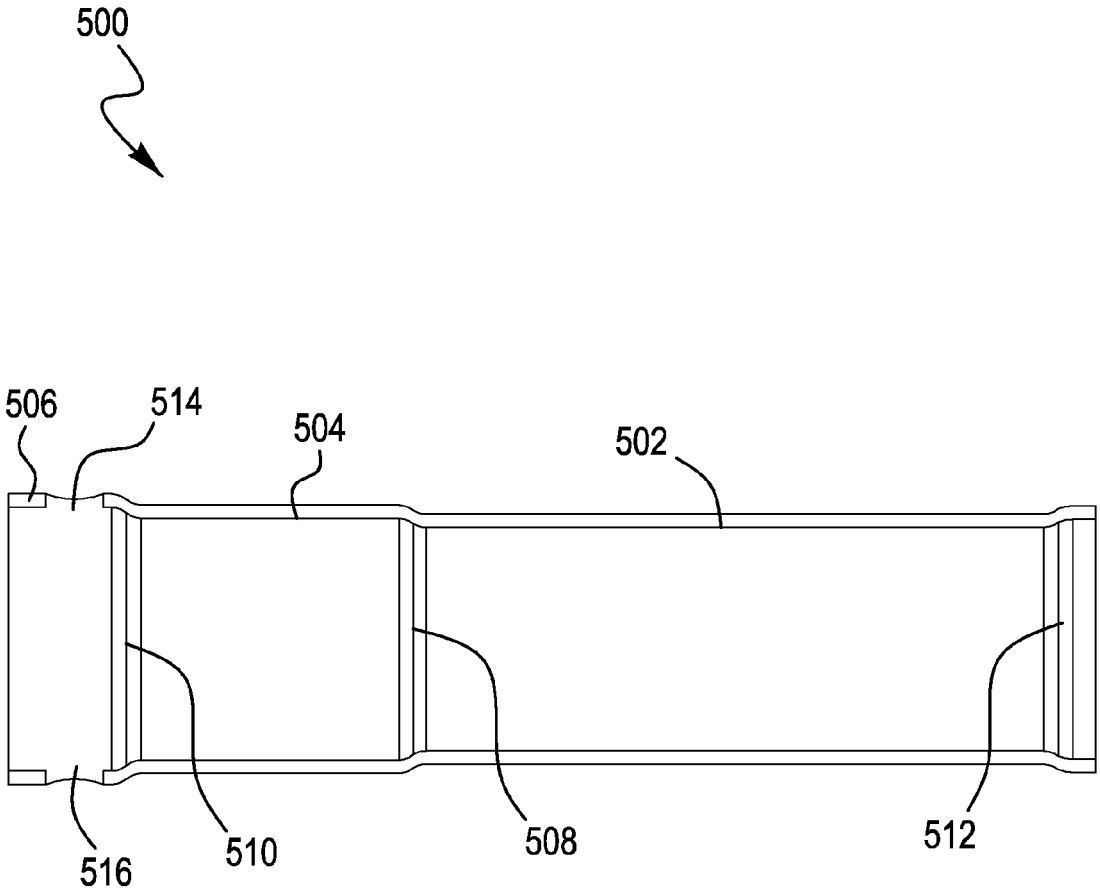

As shown in FIGS. 3A-3B, each mounting assembly 204 has several discrete components including a base 400, a shaft or post 500, a pivot pin 600, a guide 700 and a cover 800. These components can be made from a variety of materials (e.g., metal, plastic) without departing from the spirit or the scope of the general inventive concept. Furthermore, two or more of the components can be integrally formed without departing from the spirit or scope of the general inventive concept.

An exemplary base 400 is shown in FIGS. 4A-4E. The base 400 includes a body 402 having an upper surface 404 and a lower surface 406. Several mounting holes 408 extend through the body 402 of the base 400. Accordingly, with the lower surface 406 of the body 402 facing a mounting surface (e.g., mounting surface 206), a fastener (e.g., a screw) can engage the mounting surface through the mounting hole 408 to affix the base 400 to the mounting surface. One of ordinary skill in the art will appreciate that the base 400 can be affixed to the mounting surface in any known manner.

In one exemplary embodiment, the base 400 includes an open portion 410 formed at a center of the body 402. The open portion 410 reduces the amount of material needed to make the base 400, thereby providing a cost savings.

A pair of flanges 412 and 414 extend above the upper surface 404 of the body 402. In one exemplary embodiment, the flanges 412 and 414 are formed integrally with the body 402. The flanges 412 and 414 face one another and are separated by a distance greater than a diameter of the shaft 500.

The flange 412 has a threaded pivot hole 416 formed therein. The flange 414 has a non-threaded pivot hole 418 formed therein. An axis extending through the pivot holes 416 and 418 is substantially parallel to the body 402 of the base 400. The pivot holes 416 and 418 allow the shaft 500 to be pivotably attached to the base 400, as further described below.

A pair of rails 420 and 422 extend above the upper surface 404 of the body 402 on opposing sides 424 and 426 of the body 402. The rails 420 and 422 also extend slightly beyond a width of the body 402 such that a pair of recesses 428 and 430 are formed below the rails 420 and 422 on the opposing sides 424 and 426 of the body 402. The opposing sides 424 and 426 of the body 402 having the rails 420 and 422 are relatively straight and, thus, parallel to one another. The opposing sides 424 and 426 abut another pair of opposing sides 432 and 434. The opposing sides 432 and 434 are curved. Thus, the body 402 of the base 400 has two straight sides 424, 426 and two curved sides 432, 434 (see, e.g., FIG. 4C). One of ordinary skill in the art will appreciate that the body 402 of the base 400 can have other shapes.

An exemplary shaft 500 is shown in FIGS. 5A-5D. The shaft 500 is generally cylindrical. One of ordinary skill in the art will appreciate that the shaft 500 can have other shapes, which may or may not correspond to a shape of the curved shower rod 202. In one exemplary embodiment, the shaft 500 is hollow. The shaft 500 includes an upper portion 502, a middle portion 504 and a lower portion 506. A diameter of the upper portion 502 is less than a diameter of the middle portion 504. Accordingly, a bend or shoulder 508 is formed where the upper portion 502 meets the middle portion 504. The diameter of the middle portion 504 is less than a diameter of the lower portion 506. Accordingly, a bend or shoulder 510 is formed where the middle portion 504 meets the lower portion 506.

An end of the upper portion 502 furthest from the bend 508 acts as a rod interfacing end 512 for interfacing with an end 210 of the curved shower rod 202. The rod interfacing end 512 is flared such that a diameter of the rod interfacing end 512 of the upper portion 502 is greater than a diameter of the remaining upper portion 502. The diameter of the rod interfacing end 512 of the upper portion 502 can be the same as the diameter of the middle portion 504 of the shaft 500.

The lower portion 506 of the shaft 500 has a pair of pivot holes 514 and 516. The shaft 500 is connected to the base 400 by aligning the pivot holes 514 and 516 of the shaft 500 with the pivot holes 414 and 416 of the base 400. Because the shaft 500 is symmetrical, either of the pivot holes 514 or 516 of the shaft 500 can be aligned with either of the pivot holes 414 or 416 of the base 400.

Figure 6:
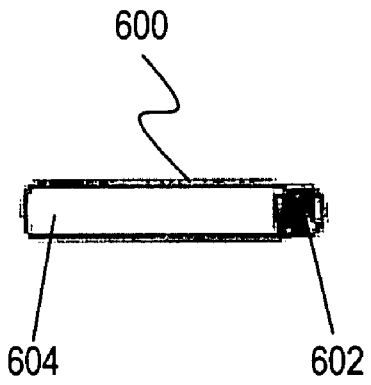
FIG. 6 is a perspective view of an exemplary pivot pin, according to an exemplary embodiment, for use in the mounting assembly of FIGS. 3A-3B.
Figure 7A:
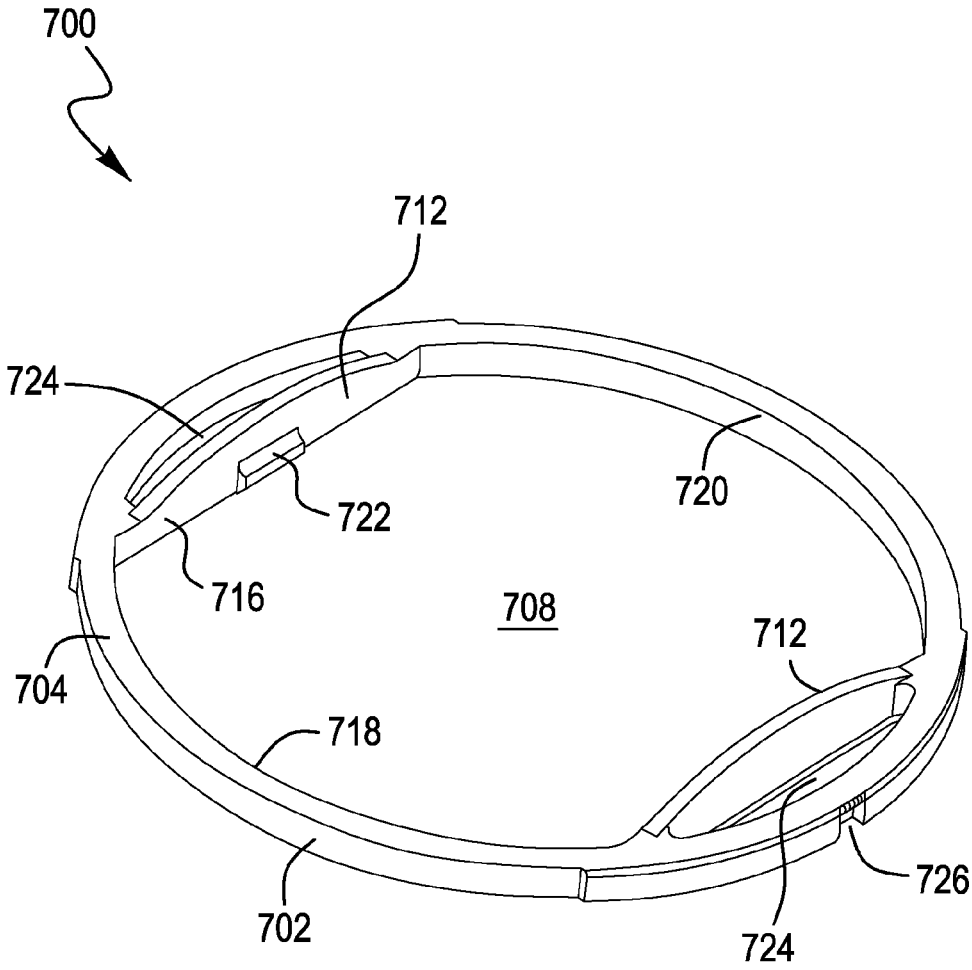
FIGS. 7A-7E show an exemplary guide, according to an exemplary embodiment, for use in the mounting assembly of FIGS. 3A-3B.
Figure 7B:
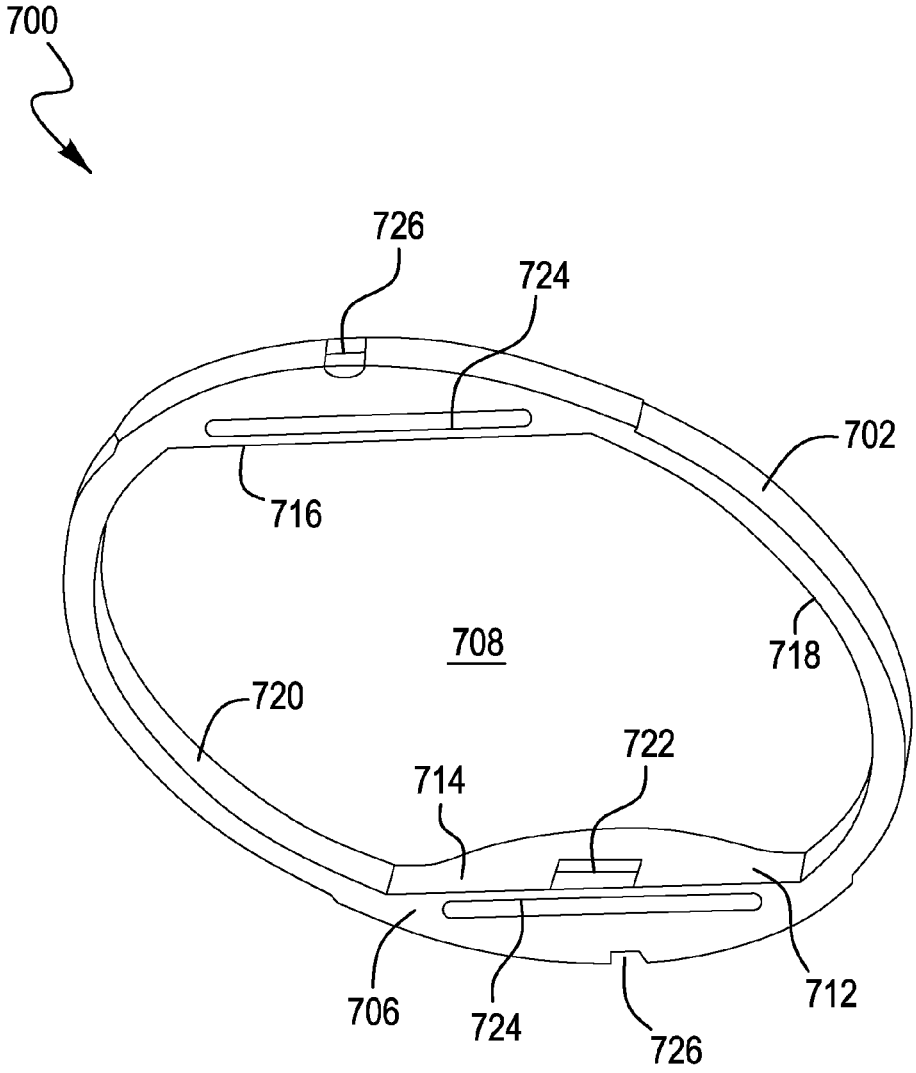
Figure 7C:
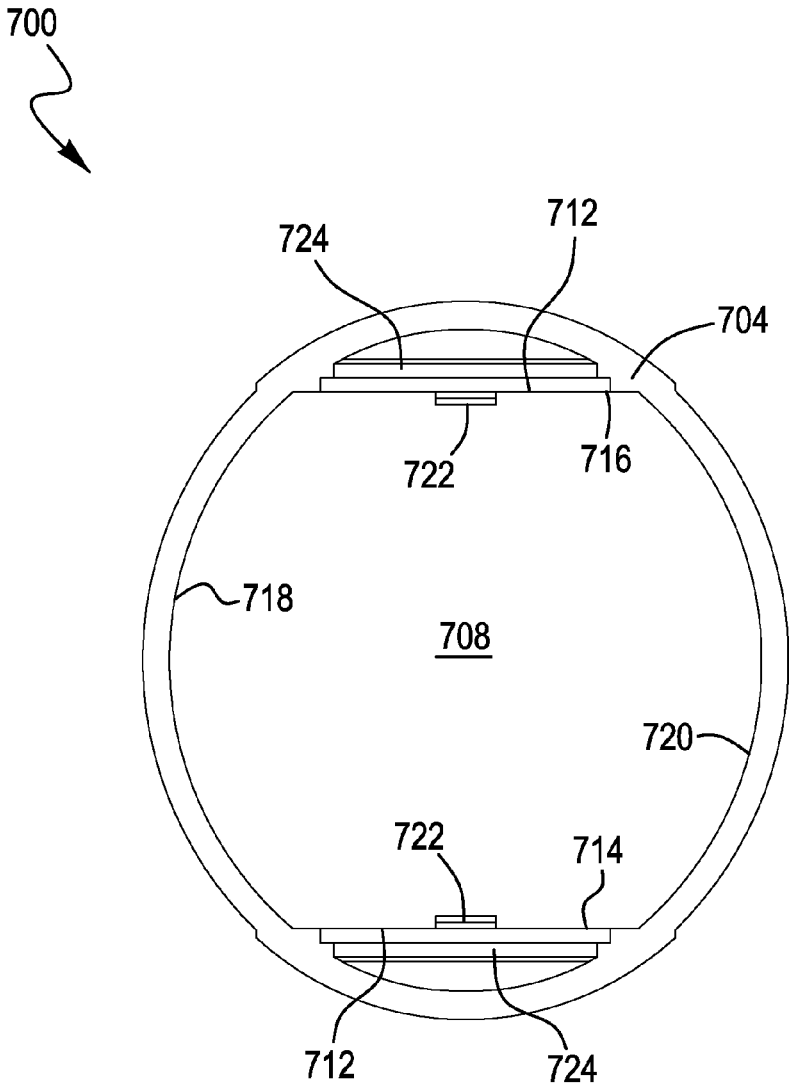
Figure 7D:
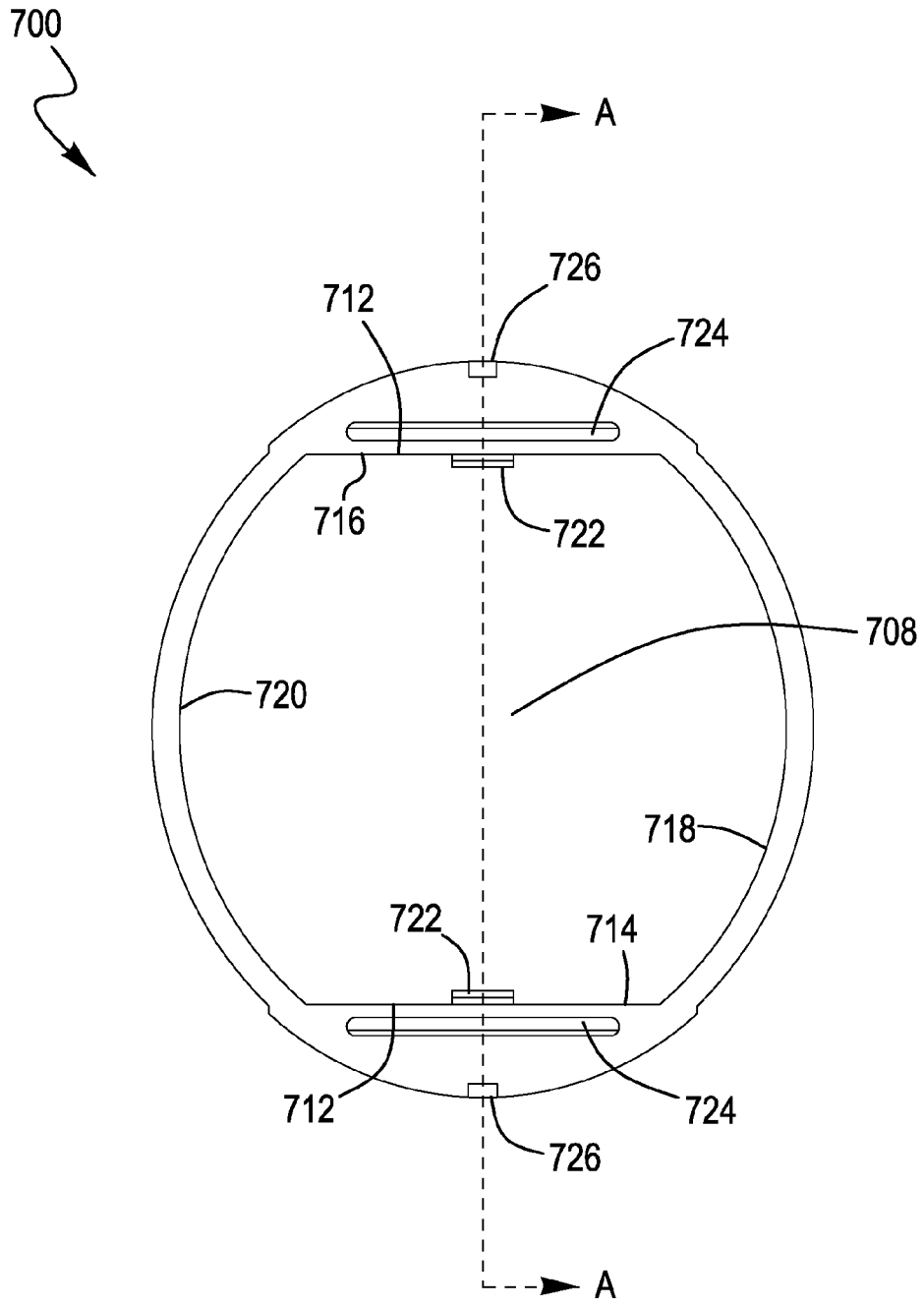
Figure 7E:
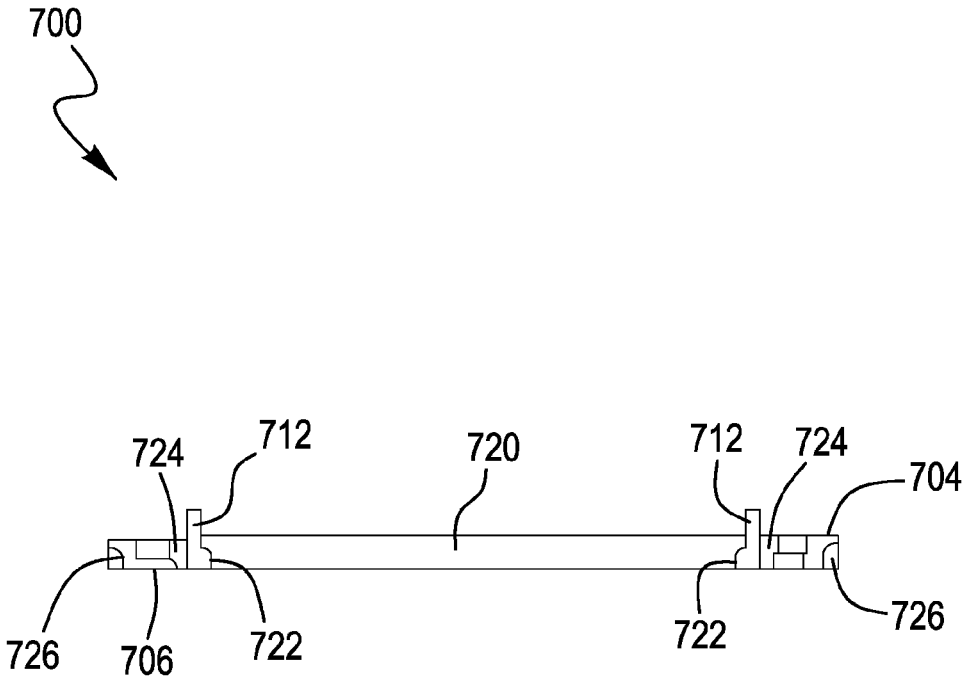
Figure 8A:
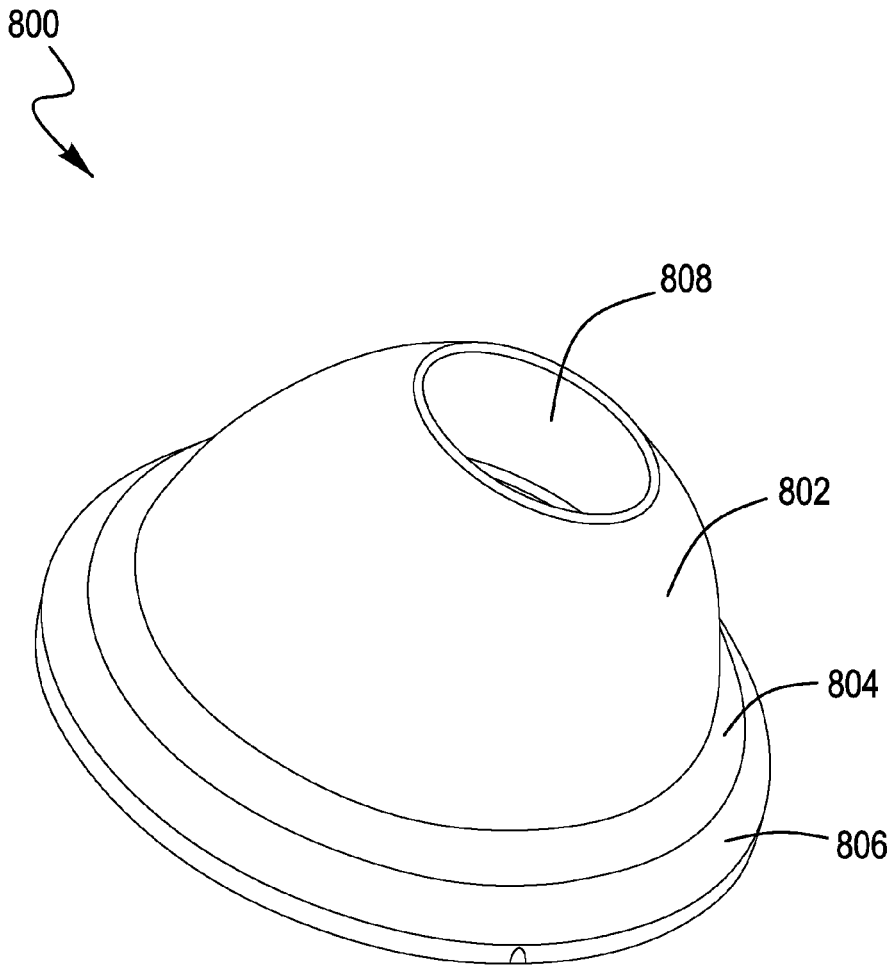
FIGS. 8A-8D show an exemplary cover, according to an exemplary embodiment, for use in the mounting assembly of FIGS. 3A-3B.
Figure 8B:
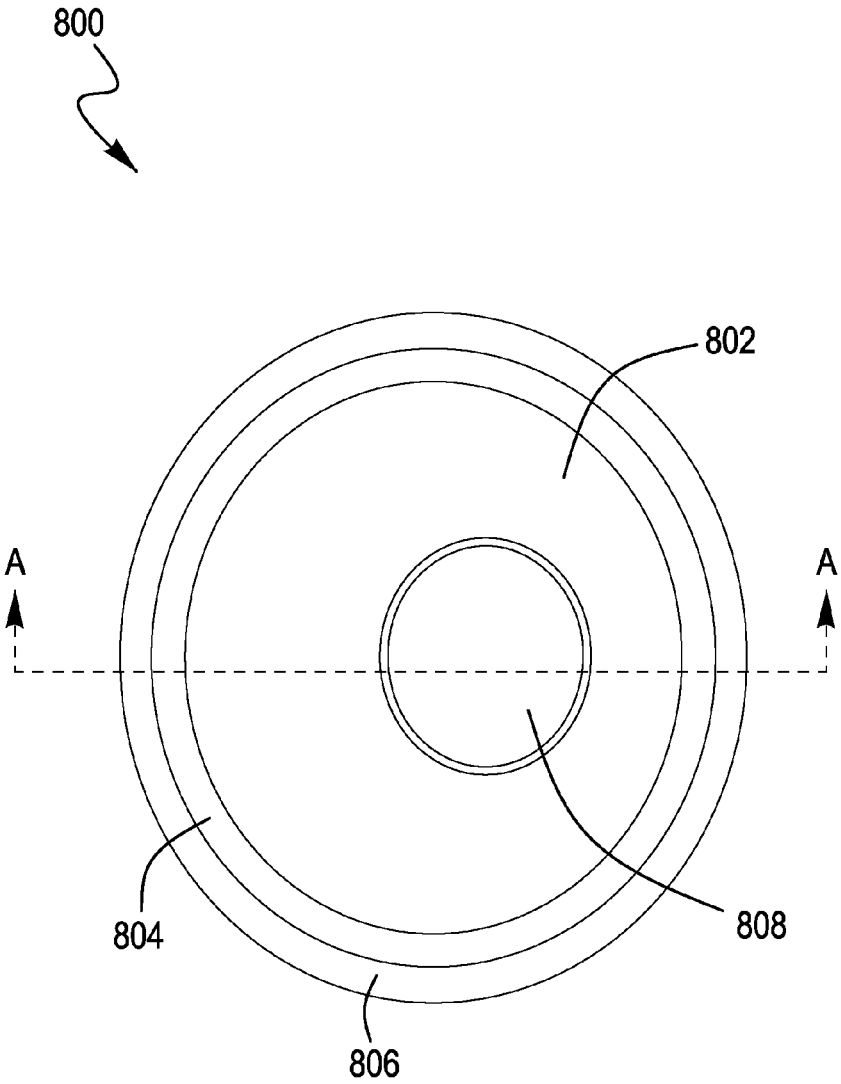
Figure 8C:
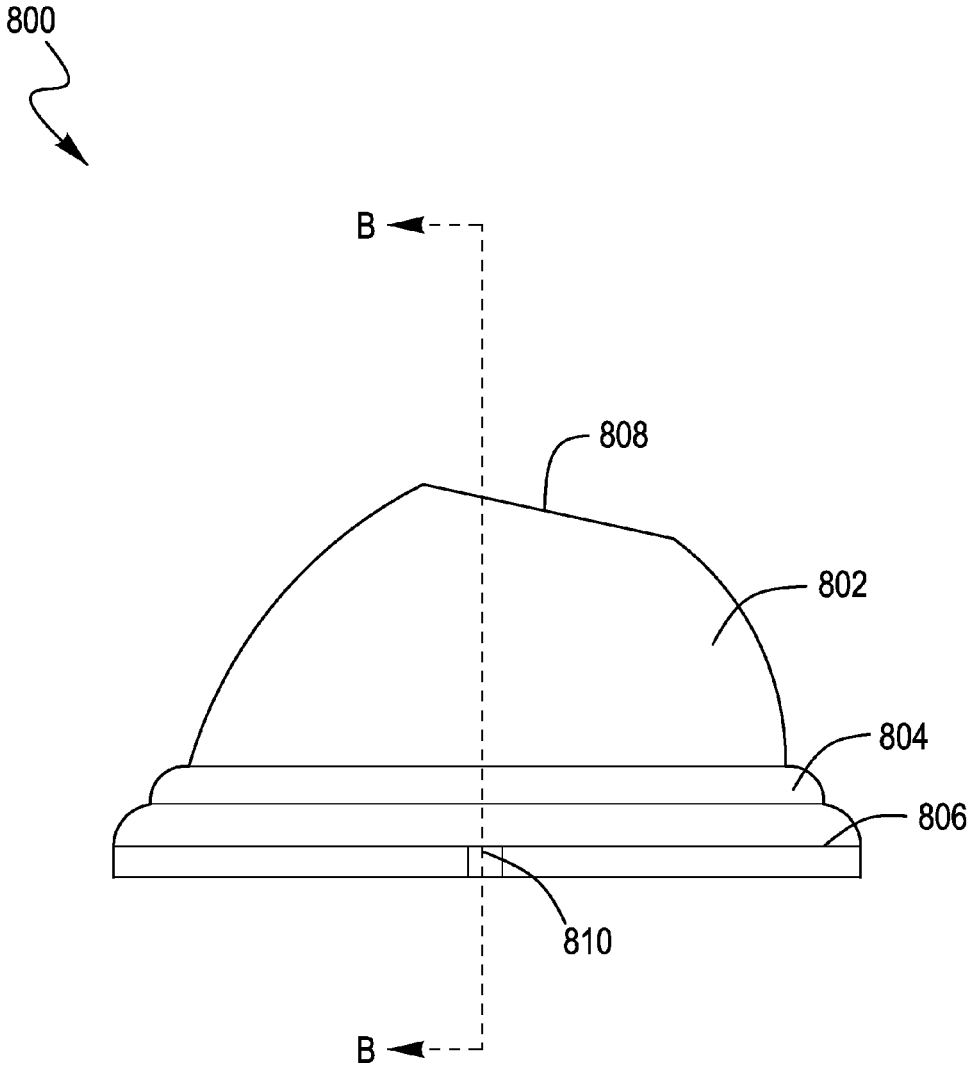
Figure 8D:
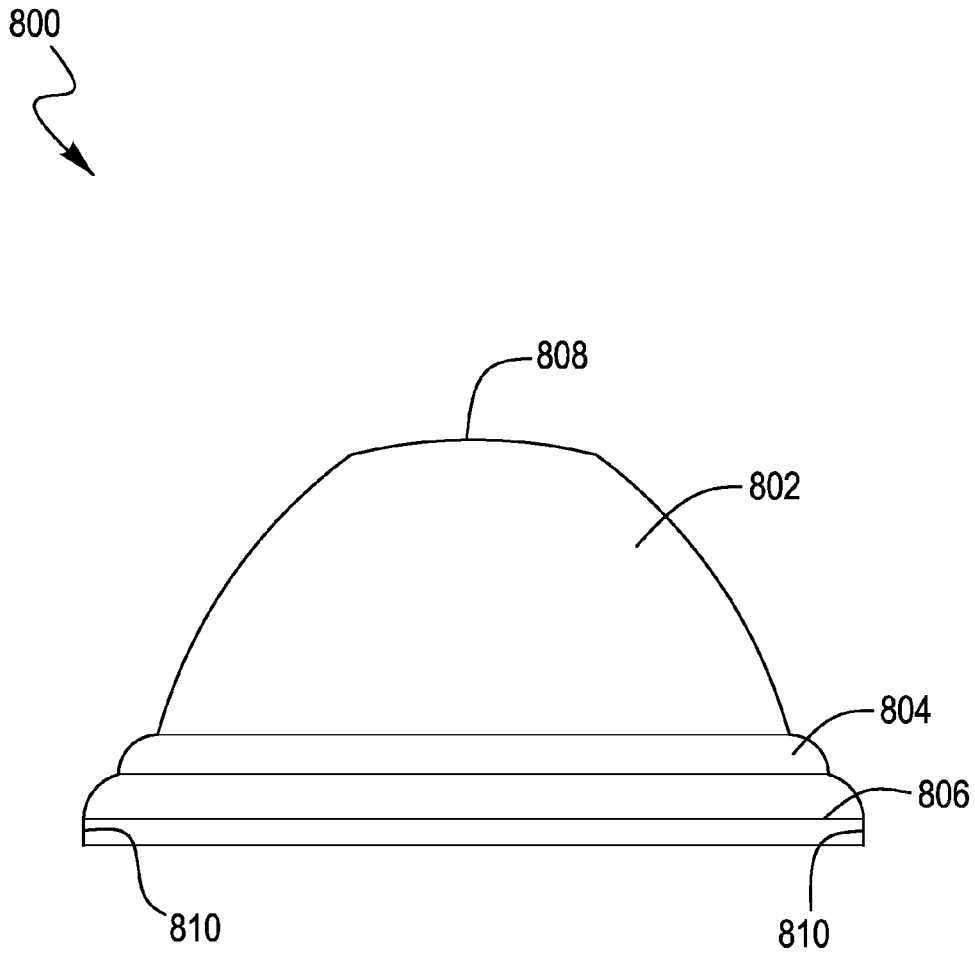

Once the pivot holes 514 and 516 of the shaft 500 are aligned with the pivot holes 414 and 416 of the base 400, the pivot pin 600 (see FIG. 6) is extended through the pivot holes 514, 516, 414 and 416 to pivotably attach the shaft 500 to the base 400 (see FIG. 3B). In one exemplary embodiment, a threaded end 602 of the pivot pin 600 engages complementary threads in the threaded pivot hole 416 of the base 400 to secure the pivot pin 600 to the base 400. Likewise, a non-threaded end 604 of the pivot pin 600 comes to rest at least partially in the non-threaded pivot hole 418 of the base 400. One of ordinary skill in the art will appreciate that both pivot holes 416 and 418 and both ends of 602 and 604 of the pivot pin 600 could be threaded. Furthermore, one of ordinary skill in the art will appreciate that both of the pivot holes 416 and 418 could be unthreaded, for example, if the ends 602 and 604 of the pivot pin 600 are friction fit into the pivot holes 416 and 418. In one exemplary embodiment, the shaft 500 is connected to the base 400 prior to the base 400 being affixed to the mounting surface.

An exemplary guide 700 is shown in FIGS. 7A-7E. The guide 700 includes a generally annular body 702 having an upper surface 704 and a lower surface 706. The annular body 702 of the guide 700 has a central opening 708. A pair of walls 712 extend across the central opening 708 of the annular body 702. The walls 712 cause the central opening 708 to have two opposing sides 714 and 716 which are generally straight. The opposing sides 714 and 716 of the central opening 708 are generally parallel to one another. The opposing sides 714 and 716 abut another pair of opposing sides 718 and 720. The opposing sides 718 and 720 are curved. Thus, the central opening 708 of the guide 700 has two straight sides 714, 716 and two curved sides 718, 720 (see, e.g., FIG. 7B). One of ordinary skill in the art will appreciate that the central opening 708 of the guide 700 can have other shapes.

An upper portion of each wall 712 extends above the upper surface 704 of the annular body 702. A lower portion of each wall 712 is flush with the lower surface 706 of the annular body 702. Each wall 712 has a tooth 722 that extends toward a center of the central opening 708. The tooth 722 is formed near the lower portion of the wall 712. In one exemplary embodiment, the tooth 722 is horizontally centered on the wall 712.

An area adjacent each wall 712 on a side of the wall 712 furthest from the center of the central opening 708 has an opening 724. In one exemplary embodiment, the openings 724 are generally slot-shaped. The openings 724 allow the walls 712 to flex away from the center of the central opening 708. A thickness of the annular body 702 of the guide may be increased proximate to the walls 712 and openings 724 to strengthen the guide 700 in a direction that the walls 712 will flex and reduce the impact of the flexing of the walls 712 on the other portions of the annular body 702.

A pair of notches 726 is formed in the lower surface 706 of the annular body 702. One of ordinary skill in the art will appreciate that the annular body 702 can have one or more of the notches 726. Furthermore, the notches 726 can be formed anywhere on a periphery of the annular body 702. In one exemplary embodiment, each notch 726 on the guide 700 is aligned with a tooth 722 on the guide 700. The notches 726 can be used to facilitate the guide 700 interfacing with the cover 800, as further described below.

An exemplary cover 800 is shown in FIGS. 8A-8D. The cover 800 is a decorative element for concealing other components of the mounting assembly 204 (e.g., the base 400, the pivot pin 600 and the guide 700) from view. As a decorative element, an appearance (e.g., color, style) of the cover 800 will often match an appearance of the curved shower rod 202 and/or other bathroom accessories. In this manner, the mounting assemblies 204 contribute to the aesthetic appeal of the curved shower rod assembly 200.

The cover 800 has a generally dome-like shape. One of ordinary skill in the art will appreciate that the cover 800 can have a different shape. In one exemplary embodiment, the cover 800 has an upper portion 802, a middle portion 804 and a lower portion 806. One of ordinary skill in the art will appreciate that the cover 800 can have one or more portions. The upper portion 802 of the cover 800 includes an opening 808. The opening 808 has a generally circular shape that corresponds to the generally cylindrical shape of the shaft 500. The portions 802, 804 and 806 of the cover 800 provide the cover 800 with a size and shape suitable for covering and concealing the remaining components of the mounting assembly 204 (see, e.g., FIG. 3B).

A pair of projections 810 are disposed on an inner surface of the lower portion 806 of the cover 800. One of ordinary skill in the art will appreciate that the cover 800 can have one or more of the projections 810. The projections 810 interface with the notches 726 on the guide 700, as further described below.

As noted above, FIGS. 3A-3B show one of the mounting assemblies 204 in assembled form. The other one of the mounting assemblies 204 is identical and, thus, need not be separately described.

During the manufacturing process for the curved shower rod assembly 200, according to one exemplary embodiment, the shaft 500 is pivotably attached to the base 400 using the pivot pin 600, and the cover 800 is attached to the guide 700 using the notches 726 and the projections 810. One of ordinary skill in the art will appreciate that attachment of the shaft 500 to the base 400 and the cover 800 to the guide 700 can occur later, for example, during installation of the curved shower rod assembly 200.

During installation of the curved shower rod assembly 200, according to one exemplary embodiment, a first assembled base 400 and shaft 500 is affixed to a first one of the mounting surfaces 206 (e.g., using one or more of the mounting holes 408 in the base 400). Then, a pair of assembled guides 700 and covers 800 are slid onto the curved shower rod 202, such that the lower surface 706 of each of the guides 700 is facing an opposite end 210 of the curved shower rod 202. The shaft 500 of a second assembled base 400 and shaft 500 is slid into a second end 210 of the curved shower rod 202. A first end 210 of the curved shower rod 202 is slid onto the shaft 500 of the first assembled base 400 and shaft 500 (already affixed to the first one of the mounting surfaces 206). The curved shower rod 202 is positioned so that the second assembled base 400 and shaft 500 interfacing with the second end 210 of the curved shower rod 202 is near a second one of the mounting surfaces 206. Then, the second assembled base 400 and shaft 500 is affixed to the second one of the mounting surfaces 206.

Each assembled guide 700 and cover 800 is then slid along the curved shower rod 202 and onto a corresponding assembled base 400 and shaft 500 (already affixed to the mounting surfaces 206), such that a lower surface 706 of each of the guides 700 faces one of the mounting surfaces 206. When the assembled guide 700 and cover 800 is slid onto the assembled base 400 and shaft 500, the shaft 500 extends through the opening 808 in the cover 800 and the remaining components of the mounting assembly 204 are substantially concealed. Likewise, the curved shower rod 202, which was slid over the shaft 500, extends through the cover 800 via the opening 808.

The cover 800 interfaces with the guide 700, which fits around the base 400, to secure the cover 800 within the mounting assembly 204. For example, the inner surface of the lower portion 806 of the cover 800 can be sized to friction fit around the annular body 702 of the guide 700. Furthermore, as noted above, the inner surface of the lower portion 806 of the cover 800 has the pair of projections 810 that fit into the pair of notches 726 of the annular body 702 of the guide 700. In this manner, the notches 726 and projections 810 can be used to secure the guide 700 in the cover 800. Furthermore, the notches 726 and projections 810 can be used to prevent rotation of the guide 700 after it is secured in the cover 800. Further still, the notches 726 and projections 810 can be used to align the cover 800 relative to the guide 700. Since the guide 700 is symmetrical about a line extending through a center of the notches 726, the guide 700 can be properly aligned in either of two orientations (separated by 180 degrees). As noted above, in one exemplary embodiment, the cover 800 interfaces with the guide 700 prior to the guide 700 being placed around the base 400. One of ordinary skill in the art will appreciate that the guide 700 could be placed around the base 400 prior to the cover 800 interfacing with the guide 700.

In surrounding the base 400, the straight sides 714 and 716 of the central opening 708 of the guide 700 are aligned with the straight sides 424 and 426 of the body 402 of the base 400. A width of the central opening 708 of the guide 700 between the sides 714 and 716 (i.e., between the walls 712) is substantially the same as a width of the base 400 between the sides 424 and 426 (including the rails 420 and 422). The openings 724 allow the walls 712 of the guide 700 to flex away from the center of the central opening 708. Accordingly, the walls 712 of the guide 700 flex to allow the teeth 722 of the sides 714 and 716 of the guide 700 to move past the rails 420, 422 into the recesses 428,430 of the base 400. Once the guide 700 is properly fit around the base 400, the lower surface 706 of the guide 700 rests on the mounting surface and the tooth 722 of each wall 712 is located in a corresponding recess 428, 430 of the base 400. Because the walls 712 of the guide 700 unflex once the tooth 722 of each wall 712 is located in the corresponding recess 428, 430, the guide 700 remains securely seated around the base 400.

The opening 808 in the cover 800 allows some of the shaft 500 (e.g., primarily the upper portion 502 of the shaft 500) to extend through the cover 800. An end 210 of the curved shower rod 202 can interface with the shaft 500 (including the portion extending through the opening 808) to mount the end 210 to the mounting surface 206 via the mounting assembly 204. The opening 808 is formed at an angle to better position the shaft 500 for interfacing with the end 210 of the curved shower rod 202 at its approaching angle (see FIG. 8C).

A diameter of the opening 808 in the cover 800 is preferably only slightly larger than a diameter of the shaft 500 and/or curved shower rod 202 extending through the opening 808. The closer the diameter of the opening 808 is to the diameter of the shaft 500 and/or curved shower rod 202, the more effective the cover 800 is at concealing the remaining components of the mounting assembly 204.

In one exemplary embodiment, the diameter of the opening 808 in the cover 800 is within 25.9 mm to 26.1 mm, the diameter of the shaft 500 is within 23.6 mm to 23.8 mm and the diameter of the curved shower rod 202 is within 25.3 mm to 25.5 mm. In another exemplary embodiment, the diameter of the opening 808 in the cover 800 is 26.0 mm, the diameter of the shaft 500 is 23.7 mm and the diameter of the curved shower rod 202 is 25.4 mm. In still another exemplary embodiment, the diameter of the opening 808 in the cover 800 is within 26.7 mm to 26.9 mm, the diameter of the shaft 500 is within 23.6 mm to 23.8 mm and the diameter of the curved shower rod 202 is within 25.3 mm to 25.5 mm. In yet another exemplary embodiment, the diameter of the opening 808 in the cover 800 is 26.8 mm, the diameter of the shaft 500 is 23.7 mm and the diameter of the curved shower rod 202 is 25.4 mm.

In one exemplary embodiment, the diameter of the opening 808 in the cover 800 is within 25.9 mm to 26.1 mm and the diameter of the curved shower rod 202 is within 25.3 mm to 25.5 mm. In another exemplary embodiment, the diameter of the opening 808 in the cover 800 is 26.0 mm and the diameter of the curved shower rod 202 is 25.4 mm. In still another exemplary embodiment, the diameter of the opening 808 in the cover 800 is within 26.7 mm to 26.9 mm and the diameter of the curved shower rod 202 is within 25.3 mm to 25.5 mm. In yet another exemplary embodiment, the diameter of the opening 808 in the cover 800 is 26.8 mm and the diameter of the curved shower rod 202 is 25.4 mm.

The opening 808 in the cover 800 limits the pivoting movement of the shaft 500 of the mounting assembly 204. Thus, the size of the opening 808 directly impacts the range of approaching angles that can be accommodated by the mounting assembly 204. In particular, as the size of the opening 808 is decreased, the range of approaching angles that can be accommodated by the mounting assembly 204 is reduced. The mounting assembly 204 of the exemplary embodiment described herein, however, is able to accommodate an expanded range of approaching angles for a smaller opening 808 in the cover 800 by allowing the cover 800 to move relative to the base 400 affixed to the mounting surface 206.

As noted above, the cover 800 fits over the guide 700 and the guide 700 surrounds the base 400. A length of the central opening 708 of the guide 700 between the curved sides 718 and 720 is greater than a length of the body 402 of the base 400 between the curved sides 432 and 434. The width of the central opening 708 of the guide 700 between the straight sides 714 and 716 (i.e., between the walls 712) is substantially the same as the width of the base 400 between the straight sides 424 and 426 (including the rails 420 and 422). Accordingly, the guide 700 can move along a length of the base 400 while any movement along the width of the base 400 is prevented. This lengthwise movement of the guide 700 is in a direction perpendicular to a central axis of the pivot pin 600 (i.e., the pivoting axis of the shaft 500).

Since the cover 800 is connected to the guide 700, the cover 800 is also able to move along the length of the base 400. The cover 800 has a range of positions between a first position and a second position. The first position of the cover 800 corresponds to the curved side 718 of the central opening 708 of the guide 700 contacting the curved side 432 of the body 402 of the base 400. The second position of the cover 800 corresponds to the curved side 720 of the central opening 708 of the guide 700 contacting the curved side 434 of the body 402 of the base 400. The cover 800 can be moved to either the first position or the second position, as well as any position between the first position and the second position.

Movement of the cover 800 results in the opening 808 in the cover 800 being repositioned. When the cover 800 is in the first position, the opening 808 in the cover 800 limits the movement of the shaft 500 of the mounting assembly 204 to define at least one approaching angle $\theta_{min}$ of the curved shower rod 202 (e.g., $\theta_1$) that can be accommodated in the first position. When the cover 800 is in the second position, the opening 808 in the cover 800 limits the movement of the shaft 500 of the mounting assembly 204 to define at least one approaching angle $\theta_{max}$ of the curved shower rod 202 (e.g., $\theta_2$) that can be accommodated in the second position.

Movement of the cover 800 over the range of positions (i.e., between the first position and the second position) allows the mounting assembly 204 to accommodate an expanded range of approaching angles of the curved shower rod 202. Thus, the mounting assembly 204 accommodates a range of approaching angles ($\theta_{min}$ to $\theta_{max}$), which is greater than the one or more approaching angles accommodated by a mounting assembly fixed at the first position, the second position or anywhere in between.

With reference to FIG. 2A, for a distance $D_3$ between the mounting surfaces 206, a length $L_4$ of the curved shower rod 202 is modified to fit between the mounting surfaces 206. One of ordinary skill in the art will appreciate that the length $L_4$ of the curved shower rod 202 can be modified to fit between the mounting surfaces 206 in any known manner.

In one exemplary embodiment, the curved shower rod 202 initially has the length $L_4$ that is greater than the distance $D_3$ between the mounting surfaces 206. By removing (e.g., cutting) a portion of the curved shower rod 202, the curved shower rod 202 is modified to have the length $L_3$, wherein the length $L_3$ is less than the distance $D_3$ between the mounting surfaces 206. To reduce the length (from $L_4$ to $L_3$) of the curved shower rod 202, a portion can be removed from either end 210 (e.g., if the curved shower rod 202 has a constant rate of curvature) or portions can be removed from both ends 210 of the curved shower rod 202.

In another exemplary embodiment, a plurality of discrete shaft segments interconnect to form the curved shower rod 202. By removing or adding a number of the segments, the overall length of the curved shower rod 202 is varied (e.g., from $L_4$ to $L_3$).

Thus, the mounting assemblies 204 are operable to mount the curved shower rod 202 having a range of lengths Lx (e.g., including $L_1$, $L_2$ and $L_3$) between the mounting surfaces 206. As a result, the mounting assemblies 204 allow the curved shower rod 202 to be installed between the mounting surfaces 206 separated by a range of distances $D_X$ (e.g., including $D_1$, $D_2$ and $D_3$). Furthermore, the mounting assemblies 204 can accommodate a range of approaching angles (e.g., $\theta_{min}$ to $\theta_{max}$) of the ends 210 of the curved shower rod 202, while having a relatively small opening 808 in the cover 800. The smaller size of the opening 808 in the cover 800 insures that the internal components of the mounting assembly 204 (e.g., the base 400, the pivot pin 600 and the guide 700) are substantially concealed from view, thereby enhancing the aesthetic appeal of the curved shower rod assembly 200.

Figure 9A:
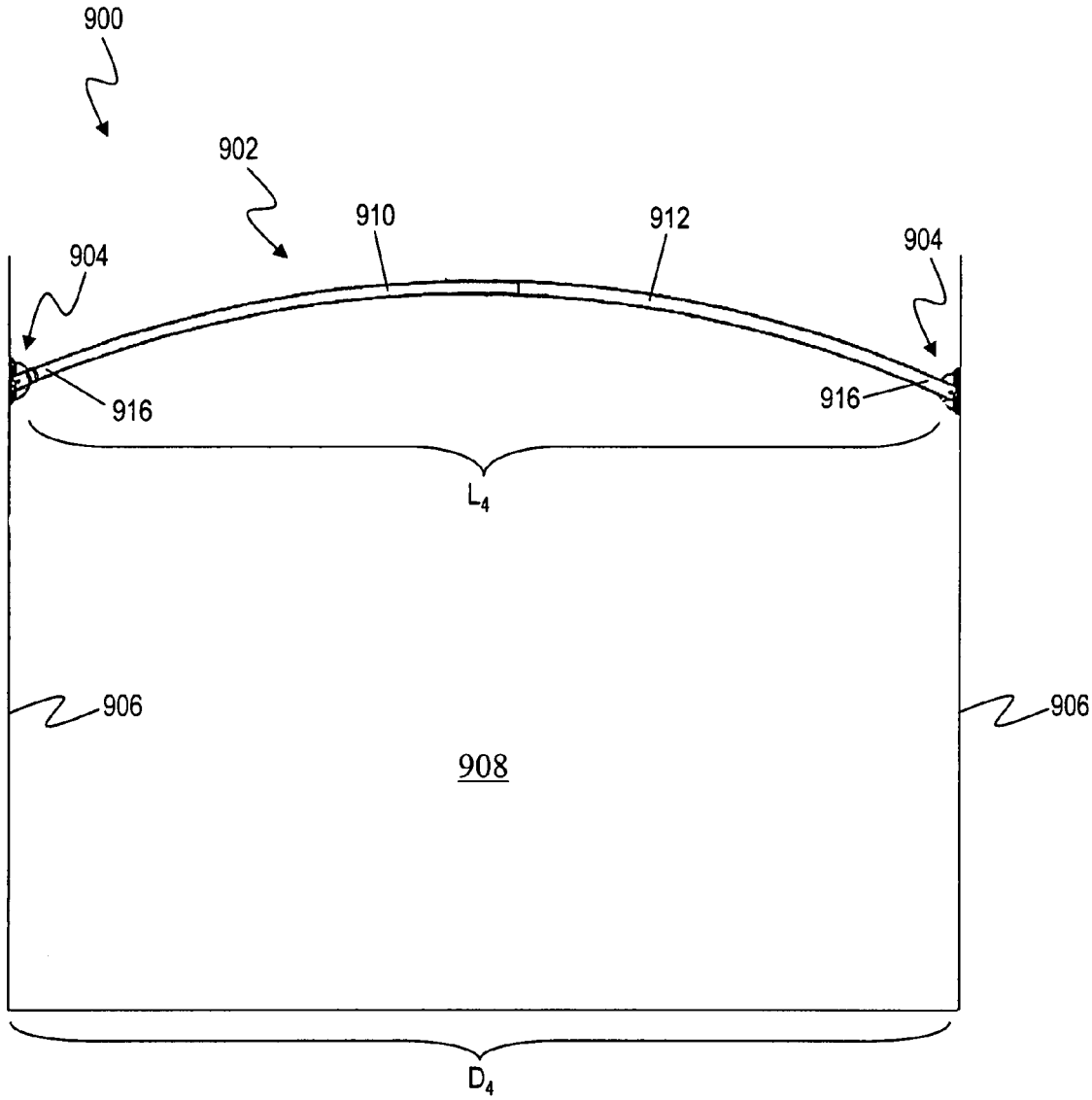
FIG. 9A is a diagram illustrating a curved shower rod having an adjustable length for installing between mounting surfaces separated by varying distances, according to another exemplary embodiment.
Figure 9B:
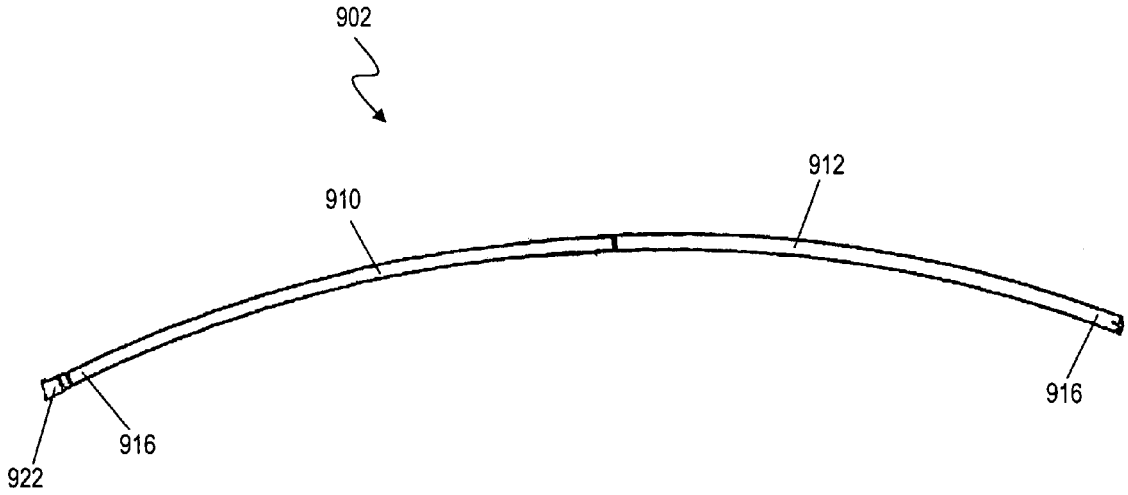
FIG. 9B is a top plan view of the adjustable curved shower rod of FIG. 9A.
Figure 9C:
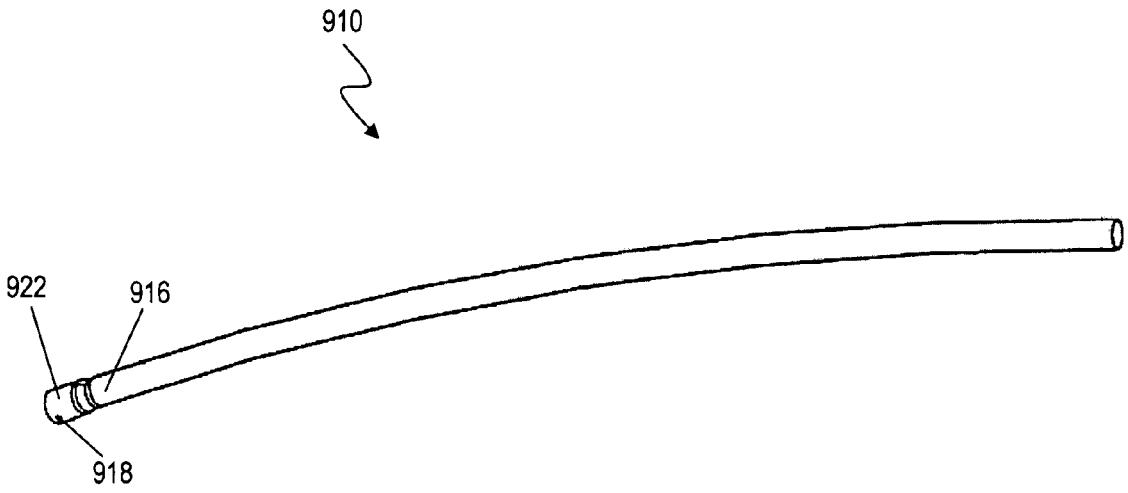
FIG. 9C is a perspective view of an inner rod of the adjustable curved shower rod of FIG. 9B.
Figure 9D:
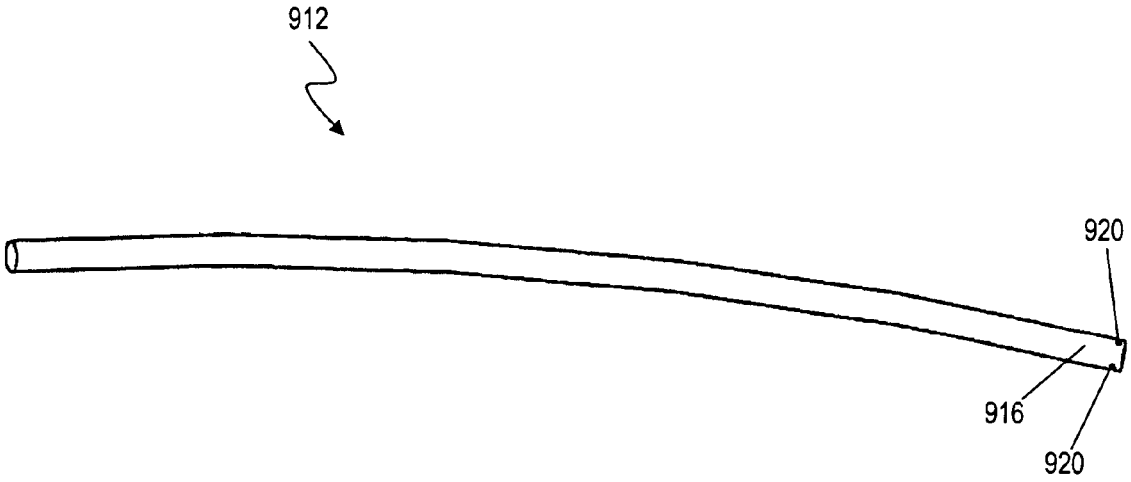
FIG. 9D is a perspective view of an outer rod of the adjustable curved shower rod of FIG. 9B.

A curved shower rod assembly 900, according to another exemplary embodiment, is shown in FIG. 9A. The curved shower rod assembly 900 includes an adjustable curved shower rod 902 (see FIGS. 9B-9D) and a pair of mounting assemblies 904. Each mounting assembly 904 is installed on a corresponding mounting surface 906 on or near a bath/shower unit 908.

In one exemplary embodiment, the curved shower rod 902 is a telescoping rod including a first curved shaft 910 (see FIG. 9C) and a second curved shaft 912 (see FIG. 9D) with at least the second curved shaft having a hollow portion. An outer diameter of the first curved shaft 910 is smaller than an inner diameter of the hollow portion of the second curved shaft 912, such that the first curved shaft 910 slidingly fits in the second curved shaft 912 (see FIG. 9B). Accordingly, the first curved shaft 910 can telescope into and out of the second curved shaft 912 to vary an overall length of the curved shower rod 902.

Each mounting assembly 904 is operable to interface with an end 916 of the curved shower rod 902 to mount the curved shower rod 902 between the mounting surfaces 906. In this manner, a shower curtain (not shown) hanging from the curved shower rod 902 can form a barrier for retaining water, discharged during a shower, in the bath/shower unit 908.

As further described below, the mounting assemblies 904 are operable to mount the curved shower rod 902 having a length adjustable within a range of lengths Lx (e.g., including $L_1$ and $L_2$) between the mounting surfaces 906. As a result, the mounting assemblies 904 allow the curved shower rod 902 to be installed between the mounting surfaces 906 separated by a range of distances $D_X$ (e.g., including $D_1$ and $D_2$). For example, if the mounting surfaces 906 are separated by the distance $D_4$, the curved shower rod 902 can be adjusted (e.g., telescoped) to change its length to the length $L_5$ that fits between the mounting surfaces 906.

The mounting assembly 904 has many components that are identical to those described above with respect to the mounting assembly 204 shown in FIGS. 3A-3B. In particular, each mounting assembly 904 includes a base 400, a pivot pin 600, a guide 700 and a cover 800. The mounting assembly 904, however, does not include a shaft 500. The components of the mounting assembly 904 can be made from a variety of materials (e.g., metal, plastic) without departing from the spirit or the scope of the general inventive concept. Furthermore, two or more of the components can be integrally formed without departing from the spirit or scope of the general inventive concept.

As noted above, the mounting assembly 904 does not include the shaft 500. Instead, the ends 916 of the curved shower rod 902 are connected directly to the base 400 of the mounting assembly 904. For example, a pair of mounting holes 918 (of which only one is shown in the drawings) extends through the first curved shaft 910 near one end 916 of the curved shower rod 902, while a pair of mounting holes 920 extends through the second curved shaft 912 near the other end 916 of the curved shower rod 902. A pair of the pivot pins 600 can be used to secure the ends 916 of the curved shower rod 902 to the bases 400 of the mounting assemblies 904.

As noted above, the diameter of the first curved shaft 910 of the curved shower rod 902 is smaller than the diameter of the second curved shaft 912 of the curved shower rod 902. Consequently, the first curved shaft 910 has a flared portion 922 near the end 916 of the curved shower rod 902. The flared portion 922 has a diameter that is substantially the same as the diameter of the second curved shaft 912 to facilitate using identical mounting assemblies 904 to mount both ends 916 of the curved shower rod 902 to the corresponding mounting surfaces 906.

During the manufacturing process for the curved shower rod assembly 900, according to one exemplary embodiment, the ends 916 of the curved shower rod 902 are pivotably attached to the base 400 using the pivot pin 600, and the cover 800 is attached to the guide 700 using the notches 726 and the projections 810. One of ordinary skill in the art will appreciate that attachment of the ends 916 of the curved shower rod 902 to the base 400 and the cover 800 to the guide 700 can occur later, for example, during installation of the curved shower rod assembly 900.

During installation of the curved shower rod assembly 900, according to one exemplary embodiment, a pair of assembled guides 700 and covers 800 are slid onto the curved shower rod 902, such that the lower surface 706 of each of the guides 700 is facing an opposite end 916 of the curved shower rod 902. Then, a first base 400 is affixed to a first one of the mounting surfaces 906 (e.g., using one or more of the mounting holes 408 in the base 400). The length $L_3$ of the curved shower rod 902 is adjusted (e.g., by sliding the first curved shaft 910 relative to the second curved shaft 912) so that the curved shower rod 902 (including the mounting assemblies 904) fits between the mounting surfaces 906 separated by the distance $D_3$. The curved shower rod 902 is positioned so that a second base 400 is near a second one of the mounting surfaces 906. Then, the second base 400 is affixed to the second one of the mounting surfaces 906.

Each assembled guide 700 and cover 800 is then slid along the curved shower rod 902 and onto a corresponding base 400 (already affixed to the mounting surface 906), such that a lower surface 706 of each of the guides 700 faces one of the mounting surfaces 906. When the assembled guide 700 and cover 800 is slid onto the base 400, the end 916 of the curved shower rod 902 extends through the opening 808 in the cover 800 and the remaining components of the mounting assembly 904 are substantially concealed.

The cover 800 interfaces with the guide 700, which fits around the base 400, to secure the cover 800 within the mounting assembly 904. For example, the inner surface of the lower portion 806 of the cover 800 can be sized to friction fit around the annular body 702 of the guide 700. Furthermore, as noted above, the inner surface of the lower portion 806 of the cover 800 has the pair of projections 810 that fit into the pair of notches 726 of the annular body 702 of the guide 700. In this manner, the notches 726 and projections 810 can be used to secure the guide 700 in the cover 800. Furthermore, the notches 726 and projections 810 can be used to prevent rotation of the guide 700 after it is secured in the cover 800. Further still, the notches 726 and projections 810 can be used to align the cover 800 relative to the guide 700. Since the guide 700 is symmetrical about a line extending through a center of the notches 726, the guide 700 can be properly aligned in either of two orientations (separated by 180 degrees). As noted above, in one exemplary embodiment, the cover 800 interfaces with the guide 700 prior to the guide 700 being placed around the base 400. One of ordinary skill in the art will appreciate that the guide 700 could be placed around the base 400 prior to the cover 800 interfacing with the guide 700.

In surrounding the base 400, the straight sides 714 and 716 of the central opening 708 of the guide 700 are aligned with the straight sides 424 and 426 of the body 402 of the base 400. A width of the central opening 708 of the guide 700 between the sides 714 and 716 (i.e., between the walls 712) is substantially the same as a width of the base 400 between the sides 424 and 426 (including the rails 420 and 422). The openings 724 allow the walls 712 of the guide 700 to flex away from the center of the central opening 708. Accordingly, the walls 712 of the guide 700 flex to allow the teeth 722 of the sides 714 and 716 of the guide 700 to move past the rails 420, 422 into the recesses 428, 430 of the base 400. Once the guide 700 is properly fit around the base 400, the lower surface 706 of the guide 700 rests on the mounting surface 906 and the tooth 722 of each wall 712 is located in a corresponding recess 428, 430 of the base 400. Because the walls 712 of the guide 700 unflex once the tooth 722 of each wall 712 is located in the corresponding recess 428, 430, the guide 700 remains securely seated around the base 400.

The opening 808 in the cover 800 allows some the end 916 of the curved shower rod 902 to extend through the cover 800. The end 916 of the curved shower rod 902 interfaces with the base 400 to mount the end 916 to the mounting surface 906 via the mounting assembly 904. The opening 808 is formed at an angle to better accommodate the end 916 of the curved shower rod 902 at its approaching angle (see FIG. 8C).

A diameter of the opening 808 in the cover 800 is preferably only slightly larger than a diameter of the end 916 of the curved shower rod 902 extending through the opening 808. The closer the diameter of the opening 808 is to the diameter of the end 916 of the curved shower rod 902, the more effective the cover 800 is at concealing the remaining components of the mounting assembly 904.

In one exemplary embodiment, the diameter of the opening 808 in the cover 800 is within 25.9 mm to 26.1 mm and the diameter of the end 916 of the curved shower rod 902 is within 25.3 mm to 25.5 mm. In another exemplary embodiment, the diameter of the opening 808 in the cover 800 is 26.0 mm and the diameter of the end 916 of the curved shower rod 902 is 25.4 mm. In still another exemplary embodiment, the diameter of the opening 808 in the cover 800 is within 26.7 mm to 26.9 mm and the diameter of the end 916 of the curved shower rod 902 is within 25.3 mm to 25.5 mm. In yet another exemplary embodiment, the diameter of the opening 808 in the cover 800 is 26.8 mm and the diameter of the end 916 of the curved shower rod 902 is 25.4 mm.

The opening 808 in the cover 800 limits the pivoting movement of the curved shower rod 902 relative to the mounting assembly 904. Thus, the size of the opening 808 directly impacts the range of approaching angles that can be accommodated by the mounting assembly 904. In particular, as the size of the opening 808 is decreased, the range of approaching angles that can be accommodated by the mounting assembly 904 is reduced. The mounting assembly 904 of the exemplary embodiment described herein, however, is able to accommodate an expanded range of approaching angles for a smaller opening 808 in the cover 800 by allowing the cover 800 to move relative to the base 400 affixed to the mounting surface 906.

As noted above, the cover 800 fits over the guide 700 and the guide 700 surrounds the base 400. A length of the central opening 708 of the guide 700 between the curved sides 718 and 720 is greater than a length of the body 402 of the base 400 between the curved sides 432 and 434. The width of the central opening 708 of the guide 700 between the straight sides 714 and 716 (i.e., between the walls 712) is substantially the same as the width of the base 400 between the straight sides 424 and 426 (including the rails 420 and 422). Accordingly, the guide 700 can move along a length of the base 400 while any movement along the width of the base 400 is prevented. This lengthwise movement of the guide 700 is in a direction perpendicular to a central axis of the pivot pin 600 (i.e., the pivoting axis of the curved shower rod 902).

Since the cover 800 is connected to the guide 700, the cover 800 is also able to move along the length of the base 400. The cover 800 has a range of positions between a first position and a second position. The first position of the cover 800 corresponds to the curved side 718 of the central opening 708 of the guide 700 contacting the curved side 432 of the body 402 of the base 400. The second position of the cover 800 corresponds to the curved side 720 of the central opening 708 of the guide 700 contacting the curved side 434 of the body 402 of the base 400. The cover 800 can be moved to either the first position or the second position, as well as any position between the first position and the second position.

Movement of the cover 800 results in the opening 808 in the cover 800 being repositioned. When the cover 800 is in the first position, the opening 808 in the cover 800 limits the movement of the curved shower rod 902 relative to the mounting assembly 904 to define at least one approaching angle $\theta_{min}$ of the curved shower rod 902 (e.g., $\theta_1$) that can be accommodated in the first position. When the cover 800 is in the second position, the opening 808 in the cover 800 limits the movement of the curved shower rod 902 relative to the mounting assembly 904 to define at least one approaching angle $\theta_{max}$ of the curved shower rod 902 (e.g., $\theta_2$) that can be accommodated in the second position.

Movement of the cover 800 over the range of positions (i.e., between the first position and the second position) allows the mounting assembly 904 to accommodate an expanded range of approaching angles of the curved shower rod 902. Thus, the mounting assembly 204 accommodates a range of approaching angles ($\theta_{min}$ to $\theta_{max}$), which is greater than the one or more approaching angles accommodated by a mounting assembly fixed at the first position, the second position or anywhere in between.

With reference to FIG. 9A, for a distance $D_4$ between the mounting surfaces 906, a length $L_5$ of the curved shower rod 902 is adjusted to fit between the mounting surfaces 906. One of ordinary skill in the art will appreciate that the length $L_5$ of the curved shower rod 902 can be adjusted to fit between the mounting surfaces 906 in any known manner.

In one exemplary embodiment, the curved shower rod 902 initially has a length $L_6$ that is greater than the distance $D_4$ between the mounting surfaces 906. By sliding the first curved shaft 910 further into the second curved shaft 912, the curved shower rod 902 is modified to have the length $L_5$, wherein the length $L_5$ is less than the distance $D_4$ between the mounting surfaces 906. In another exemplary embodiment, the curved shower rod 902 initially has a length $L_7$ that is too small to properly mount the curved shower rod 902 between the mounting surfaces 906 separated by the distance $D_4$. By sliding the first curved shaft 910 further out of the curved shaft 912, the curved shower rod 902 is modified to have the length $L_5$ which allows the curved shower rod 902 to be properly mounted between the mounting surfaces 906.

Thus, the mounting assemblies 904 are operable to mount the curved shower rod 902 having a range of lengths $L_X$ (e.g., including $L_1$, $L_2$ and $L_5$) between the mounting surfaces 906. As a result, the mounting assemblies 904 allow the curved shower rod 902 to be installed between the mounting surfaces 906 separated by a range of distances $D_X$ (e.g., including $D_1$, $D_2$ and $D_4$). Furthermore, the mounting assemblies 904 can accommodate a range of approaching angles (e.g., $\theta_{min}$ to $\theta_{max}$) of the ends 916 of the curved shower rod 902, while having a relatively small opening 808 in the cover 800. The smaller size of the opening 808 in the cover 800 insures that the internal components of the mounting assembly 204 (e.g., the base 400, the pivot pin 600 and the guide 700) are substantially concealed from view, thereby enhancing the aesthetic appeal of the curved shower rod assembly 900.

The above description of specific embodiments has been given by way of example. From the disclosure given, those skilled in the art will not only understand the general inventive concept and its attendant advantages, but will also find apparent various changes and modifications to the structures and methods disclosed. For example, while the above described exemplary embodiments relate to mounting a curved shower rod, the general inventive concept is applicable to mounting any curved rod (e.g., a curved towel bar) between two surfaces. Furthermore, while the above described exemplary embodiments describe a fixed curved rod interfacing with a shaft attached to a base (see FIG. 2A) and an adjustable curved rod interfacing directly with the base (see FIG. 9A), one or ordinary skill in the art will appreciate that the adjustable curved rod could interface with the shaft attached to the base and the fixed curved rod could interface directly with the base. It is sought, therefore, to cover all such changes and modifications as fall within the spirit and scope of the general inventive concept, as defined herein, and equivalents thereof.

The invention claimed is:

1. An apparatus for mounting a curved rod, the apparatus comprising:

a base that can be secured to a surface;

a cover that substantially covers the base, wherein the cover includes an opening through which the curved rod can extend;

wherein the cover is operable to move relative to the base between a first position and a second position;

wherein when the cover is at the first position, the opening defines at least one first mounting angle for mounting the curved rod;

wherein when the cover is at the second position, the opening defines at least one second mounting angle for mounting the curved rod; and wherein when the cover is at a third position between the first position and the second position, the opening defines at least one third mounting angle for mounting the curved rod.

2. The apparatus of claim 1, wherein the curved rod includes a first shaft that is received in a second shaft, and wherein a length of the curved rod is adjustable by moving the first shaft relative to the second shaft.

3. The apparatus of claim 1, wherein the curved rod is cylindrical;

wherein the opening is circular; and wherein a ratio of a largest diameter of the curved rod to a diameter of the opening is within 0.941 and 0.985.

4. The apparatus of claim 1, wherein the base is operable to interface with an end of the curved rod.

5. The apparatus of claim 4, wherein the base includes a first flange and a second flange;

wherein the first flange and the second flange extend perpendicular to the base;

wherein the first flange and the second flange are generally parallel; and wherein the end of the curved rod is pivotably connected to the base via the first flange and the second flange.

6. The apparatus of claim 1, further comprising a shaft pivotably connected to the base, wherein the shaft is operable to interface with an end of the curved rod.

7. The apparatus of claim 6, wherein the shaft is cylindrical;

wherein the opening is circular; and wherein a ratio of a largest diameter of the shaft to a diameter of the opening is within 0.877 and 0.919.

8. The apparatus of claim 6, wherein the base includes a first flange and a second flange;

wherein the first flange and the second flange extend perpendicular to the base;

wherein the first flange and the second flange are generally parallel; and wherein the shaft is pivotably connected to the base via the first flange and the second flange.

9. An apparatus for mounting a curved rod, the apparatus comprising:

a base that can be secured to a surface;

a cover that substantially covers the base; and a guide, wherein the cover includes an opening through which the curved rod can extend;

wherein the cover is operable to move relative to the base between a first position and a second position;

wherein when the cover is at the first position, the opening defines at least one first mounting angle for mounting the curved rod;

wherein when the cover is at the second position, the opening defines at least one second mounting angle for mounting the curved rod;

wherein the guide fits around the base and is operable to move along the base between the first position and the second position; and wherein the cover is operable to connect to the guide.

10. The apparatus of claim 9, wherein the guide includes a notch for interfacing with a projection formed on the cover to connect the cover to the guide.

11. The apparatus of claim 9, wherein the guide has a central opening;

wherein a first wall and a second wall extend across the central opening;

wherein the first wall and the second wall are generally parallel;

wherein the base has a first rail and a second rail formed on opposing sides of the base;

wherein the first rail and the second rail are generally parallel; and wherein the first rail contacts the first wall and the second rail contacts the second wall when the guide surrounds the base.

12. The apparatus of claim 11, wherein a tooth projects from the first wall into the central opening;

wherein a recess extends along a bottom of the first rail; and wherein the tooth is located in the recess when the guide surrounds the base.

13. The apparatus of claim 1, wherein a central axis of the opening is offset from a central axis of the cover.

14. A curved rod assembly comprising:

a curved rod; and a pair of mounting assemblies, each of the mounting assemblies including:

a base that can be secured to a surface; and a cover that substantially covers the base;

wherein for each of the mounting assemblies:

the cover includes an opening through which the curved rod can extend;

the cover is operable to move relative to the base between a first position and a second position;

when the cover is at the first position, the opening defines at least one first mounting angle for mounting the curved rod;

when the cover is at the second position, the opening defines at least one second mounting angle for mounting the curved rod; and when the cover is at a third position between the first position and the second position, the opening defines at least one third mounting angle for mounting the curved rod.

15. The apparatus of claim 14, wherein the base is operable to interface with an end of the curved rod.

16. The apparatus of claim 14, further comprising a shaft pivotably connected to the base, wherein the shaft is operable to interface with an end of the curved rod.

17. An apparatus for mounting a curved rod, the apparatus comprising:

a base that can be secured to a surface; and a guide that is operable to move relative to the base between a first position and a second position to define at least two mounting angles for mounting the curved rod.

18. The apparatus of claim 17, wherein the guide fits around the base and is operable to move along the base between the first position and the second position.

19. The apparatus of claim 17, wherein the guide is operable to connect to a cover that substantially covers the base;

wherein the cover includes an opening through which the curved rod can extend;

wherein the cover is operable to move relative to the base between the first position and the second position;

wherein when the cover is at the first position, the opening defines at least one first mounting angle for mounting the curved rod; and wherein when the cover is at the second position, the opening defines at least one second mounting angle for mounting the curved rod.

* * * * *